US012673247B2

(12) United States Patent
Parker

(10) Patent No.: US 12,673,247 B2
(45) Date of Patent: Jul. 7, 2026

(54) ATHLETE REACTION-TRAINING SYSTEMS AND ATHLETE AGILITY-TRAINING SYSTEMS

(71) Applicant: Raymond Parker, Austin, TX (US)

(72) Inventor: Raymond Parker, Austin, TX (US)

( * ) Notice: Subject to any disclaimer, the term of this patent is extended or adjusted under 35 U.S.C. 154(b) by 73 days.

(21) Appl. No.: 18/910,324

(22) Filed: Oct. 9, 2024

(65) Prior Publication Data

US 2026/0097289 A1 Apr. 9, 2026

(51) Int. Cl.
*A63B 69/02* (2006.01)

(52) U.S. Cl.
CPC ..... *A63B 69/02* (2013.01)

(58) Field of Classification Search
CPC . A63B 69/02; A63B 71/0622; A63B 71/0686; A63B 2071/0625; A63B 2071/0694; A63B 2214/00; A63B 2220/80; A63B 2220/803; A63B 2220/805; A63B 2220/83; A63B 2220/833
See application file for complete search history.

(56) References Cited

U.S. PATENT DOCUMENTS

| | | | | |
|---|---|---|---|---|
| 3,492,582 | A | 1/1970 | Heywood | |
| 4,645,458 | A | 2/1987 | Williams | |
| 4,702,475 | A | 10/1987 | Elstein et al. | |
| 5,516,334 | A | 5/1996 | Easton | |
| 7,959,501 | B2 * | 6/2011 | Harmon | A63B 69/0053 473/445 |
| 9,292,935 | B2 | 3/2016 | Koduri et al. | |
| 2007/0213126 | A1 | 9/2007 | Deutsch et al. | |
| 2008/0102991 | A1 | 5/2008 | Hawkins | |
| 2019/0118066 | A1 | 4/2019 | Cardona et al. | |
| 2022/0040524 | A1 | 2/2022 | Miller et al. | |
| 2022/0168621 | A1 * | 6/2022 | D'Alesio | A63B 69/32 |
| 2023/0013469 | A1 | 1/2023 | Koren | |
| 2025/0345684 | A1 * | 11/2025 | Bandawe | A63B 71/0622 |

FOREIGN PATENT DOCUMENTS

| | | | | |
|---|---|---|---|---|
| BR | 8700669 A | * | 3/1988 | A63B 69/0053 |
| CN | 108905142 A | * | 11/2018 | A63B 69/0053 |
| ES | 2754046 T3 | * | 4/2020 | G16H 40/60 |
| IT | 202200024468 A1 | * | 5/2024 | A63B 71/0605 |
| JP | 2024540843 A | * | 11/2024 | F41J 5/14 |
| KR | 20250138884 A | * | 9/2025 | A63B 21/023 |
| WO | 2009039661 | | 4/2009 | |

* cited by examiner

*Primary Examiner* — Gary D Urbiel Goldner
(74) *Attorney, Agent, or Firm* — Jerome Drabiak; Justin Lefkowitz; Edison Law Group, PLLC

(57) ABSTRACT

An athlete agility-training system includes a frame and a plurality of mounting plates. Each mounting plate is removably secured to an associated position on the frame. The frame includes at least one athlete agility-training (or reaction-training) device removably secured to one of the plurality of mounting plates. Each mounting plate includes a shank portion that extends from a device-mounting portion. The device-mounting portion is planar and substantially circular. A first end portion of the shank of the mounting plate is unitary with a peripheral-edge portion of the planar and substantially circular device-mounting portion.

5 Claims, 28 Drawing Sheets

ATHLETE REACTION-TRAINING SYSTEMS AND ATHLETE AGILITY-TRAINING SYSTEMS

FIELD

The present subject matter is directed, in general, to agility-training devices, and more particularly, to systems for enabling people to train—and thus improve—their agility.

BACKGROUND

The term "agility" or "nimbleness," which shall be understood throughout this patent specification to refer to an ability to change the body position of a person quickly, shall further be understood to require integration of a variety of isolated movement skills using a combination of balance, coordination, speed, reflexes, strength, and endurance. The term "agility" or "nimbleness" is more particularly dependent on at least the following skills: overall balance, static balance, dynamic balance, speed, strength, and coordination.

Overall Balance:—Shall be understood as referring to a person's ability to maintain equilibrium when stationary or moving—and therefore not fall—through the coordinated actions of one's sensory functions (eyes, ears, and proprioceptive organs in one's joints).

Static Balance:—Shall be understood as referring to a person's ability to retain one's center of mass above a base of support when the person is in a stationary position.

Dynamic Balance:—Shall be understood as referring to a person's ability to maintain one's balance with body movement (also known as equal distribution of weight).

Speed:—Which shall refer to one's ability to move all or part of one's body quickly.

Strength:—Which is the ability of a muscle or muscle group to overcome resistance.

Coordination:—The ability to control movement of one's body in co-operation with the sensory functions of the body (e.g., catching a ball [aka "eye-and-hand" coordination]).

In sports, agility or nimbleness is often defined in terms of an individual sport, due to it being an integration of several skill components, each used differently. J. M. Sheppard and W. B. Young [*Journal of Sport Sciences,* 24(9): 919-932A (September 2006)] defined agility as "rapid . . . body movement with change of direction or velocity in response to a stimulus."

Agility is also an important attribute in many role-playing games, including but not limited to video games, e.g., POKÉMON, and tabletop games, e.g., DUNGEONS & DRAGONS. Agility may affect a player's ability to evade an enemy's attack or make one's own move.

In modern-day psychology, author, psychologist, and executive coach Susan David introduces a concept that she calls "emotional agility," defined as: "being flexible with one's thoughts and feelings so one can respond optimally to everyday situations." ["Teaching Your Child Emotional Agility"—*The New York Times*—(Oct. 4, 2016).]

Relevant prior art includes the following patents and published patent applications. U.S. Pat. No. 3,492,582 to Heywood discloses a method and a system for teaching proper pace rhythm to track runners. The system includes a head frame for a runner, an audio oscillator and receiver on the head frame, a combination coach's console including a radio transmitter, a stopwatch, a tape player, and a frequency-controllable audio frequency generator for transmitting select controllable audio frequency pulse signals to the runner.

U.S. Pat. No. 4,645,458 to Williams discloses a method and apparatus for testing and enhancing a football player's ability to react to visual stimuli. When leaving a starting position, first and second timers begin counting. When a player reaches a first reaction point, the first counter is stopped and adapted to indicate how long it takes for a player to reach the first reaction point. Simultaneously, one light from a battery of lights is energized thus indicating that the athlete must undertake and complete a preselected action. Such action may represent cutting right or left or may require the athlete to throw a ball at a preselected target. The second timer is stopped when all the required actions have been completed thus giving an indication of how long it took the player to run the entire course.

U.S. Pat. No. 4,702,475 to Elstein et al. discloses a training system for improving technique and accelerated reaction of a person. The system includes an array of lights positioned in front of the person. Each light signifies several movement patterns to be executed by the person within a preselected amount of time. A control system selectively energizes each light, one at a time, to prompt an associated pre-programmed movement pattern to be executed by the person. The control system, programmable to enter various response times, per light, records an actual response time for each person. Audible feedback supplied by an acoustic transducer activated by the control system at the end of a response period, audibly signals, for example by beeping for the executing person.

U.S. Pat. No. 5,516,334 to Easton discloses an interactive exercise monitor that is adapted to compute and display time, distance, pace, and energy expended by a user performing a repetitive workout around a predetermined course. The exercise monitor includes a stationary transmitter located along the workout course and a receiver carried by the user. The transmitter emits a limited range signal detected by the receiver each time the user passes the transmitter during the user's workout. The receiver includes a central processing unit into which a precise distance of a course may be preprogrammed, and which may then be capable of computing a total distance accumulated by a user, an elapsed time, and other desired parameters. In addition, a user may enter information, e.g., his/her weight and a desired time, distance, and pace of a workout into the receiver.

US 2007/0213126 to Deutsch et al. discloses a training and testing apparatus for at least one athlete. The apparatus includes a control unit adapted and configured to implement a predetermined protocol; and a plurality of remote units for providing a series of stimuli for the athlete in accordance with the protocol. The apparatus includes at least one sensor for providing, to the control unit, feedback data associated with the athlete's response to the stimuli; and a communications network adapted and configured for providing communications between the control unit, plural remote units, and the sensor.

US 2008/0102991 to Hawkins discloses a system that measures reaction times of athletes and saves intercept positions, using a computer-implemented display of simulated sport projectiles and their direction, using several magnetic, contact, and/or light triggered position detectors in virtual athlete intercept positions. Associated software, programmed to enable athletes to engage in virtual training sessions, is also included.

U.S. Pat. No. 9,292,935 to Koduri et al. discloses systems for evaluating exercise performance of a user by employing one or more intelligent sensors, including at least one camera-based sensor configured to detect user image data. The camera-based sensor may be mounted on any suitable structure, including a stationary exercise device. One such system with a camera-based sensor may include a performance assessment module stored in memory and executable by one or more processors for determining a predetermined exercise performance condition of a user, based in part, on the detected image data. An output module may output an evaluation of the exercise performance condition or an instruction to take corrective action. Such a fitness system may thereby provide real-time, constructive feedback regarding each user's exercise performance based on the sensed data and utilizing fuzzy logic and other forms of intelligent software.

US 2019/0118066 to Cardona et al. discloses a fitness training system and method able to provide interactive physical exercise using one or more smart fitness equipment ("SFE") devices. The method may receive an authentication request from an SFE device initiated by a user via an authenticator. After retrieving a profile representing a set of predefined data relating to a user from a user profile storage pursuant to an authentication request, an interactive fitness plan is generated based on the profile and a predetermined set of datasets user profiles produced by one or more fitness machine learning modules using cloud-provided data. Upon activating a set of sensors able to monitor individual users in accordance with the interactive fitness plans, various movements associated with each user are detected and/or sensed by the sensors. The system is configured to provide interactive feedback to the user during the workout in response to detected movements.

US 2022/0040524 to Miller et al. discloses a system and method for athletic drill training using networked devices. A networked device, arranged to lay out a drill for an athlete, includes a sound source to indicate to an athlete where to be at a predetermined time. The system and method are flexible enough to be used for most athletic drills. An input device to indicate to athletes near a networked device may be added for agility drills.

US 2023/0013469 to Koren discloses a training device which includes a first set of time of flight ("Time" of "Flight") sensors positioned to face in a first direction, a plurality of addressable red light-, green light-, and blue ("RG&B") light-emitting diodes ("LEDs") positioned to face in the first direction, and a second set of "T" of "F" sensors positioned to face in a second direction perpendicular to the first direction. The training device includes one or more processors that can determine a training program for a user that includes visual signals representing a plurality of actions for performance by a user. For each of the plurality of actions, the training device may cause a first set of the plurality of addressable RG&B LEDs to provide a visual indication of a corresponding action for performance by a user and detect whether the user performed the corresponding action.

WO 2009/039661 to Strong et al. discloses a reaction training system having a playing surface, and a plurality of reaction pods in communication with a programmable controller. The reaction pods each have an indicator light controlled by the controller and a reaction sensor monitored by the controller and triggered by a sports article such as a puck or ball attached to the reaction pod. The controller may be programmed to execute a training program which may activate an indicator light on different reaction pods in turn. Reaction time for an athlete to respond, by touching or hitting a sports article, is measured and the data logged by the controller. The logged data is associated with an athlete. Data and time can be compiled, analyzed, and later displayed for monitoring training progress.

While U.S. Pat. No. 3,492,582 is directed toward athletes training to improve their track and field times, U.S. Pat. No. 4,645,458 is directed toward training athletes interested in improving their football performance skills, and U.S. Pat. No. 5,516,334 is directed toward training athletes interested in improving repetitive workout (e.g., walking, jogging, running) performance skills, the prior art does not disclose improving fencing technique or skills.

A commercially available interactive system designed, adapted, and configured for enabling athletes to improve their fencing agility, skills, or techniques would be desirable.

SUMMARY

Embodiments of the present subject matter include fencing-skills agility-training athlete-interactive systems. Embodiments includes a frame and a plurality of mounting plates. Each plate is removably secured to an associated mounting position on the frame. The frame includes at least one athlete agility-training (or athlete reaction-training) device removably secured to an associated mounting plate. Each mounting plate includes a shank portion extending from a device-mounting portion. Each device-mounting portion is planar and essentially circular. One end portion of each mounting plate shank is unitary with a peripheral-edge portion of the essentially circular, planar device-mounting portion.

The present subject matter includes an assortment of different embodiments. One embodiment is directed to an athlete reaction-training system comprising a primary frame, to which at least one athlete reaction-training device (or "target") is removably mounted.

Highlights of a Primary Frame: (1) There are many locations to mount a target, as illustrated by an embodiment of the present subject matter shown in FIG. 4A. (2) A front (or foreground) arm can be set at preselected angles laterally at a shoulder joint and/or a wrist joint. (3) A front (or foreground) arm can be set at preselected angles vertically at a shoulder joint and/or a wrist joint. (4) A preferred embodiment of the frame is dimensioned and configured to be easily movable across a surface. (5) Height of main body of primary frame is adjustable. (6) Leg member is removably attachable to a variable-height hip location on frame. (7) Frame has a knee joint and a foot target location. (8) Frame has arm in back (or background) that can be lifted and secured in place; and a target in rear (or background) that can be adjusted to a different depth and fixed in place. (9) Frame has a weighted base to prevent tipping over. (10) Mount "points" (or locations) for a target accept either a reaction-training device by itself or a reaction-training device to which is removably mounted a primary-feature embodiment of the present subject matter. (11) Most target locations have targets (only) mounted to these target locations, which requires an athlete to "touch" a specific location; however, a target could have an agility-training device (a primary-feature embodiment of the present subject matter) attached to it; and, if so, an athlete will get credit for a "touch" simply by jostling the frame. (12) A target is removably attached to a frame via a "twist connection" to a mounting plate removably secured to a frame. Each target has a skirt including a plurality of extensions; and each mount includes a similar plurality of helical apertures, where each aperture has a progressively narrowing opening sized and configured to receive a respective one of the skirt extensions at a wider portion of the opening and to "lock-in-place" the extension at a narrower portion of the opening. (13) Another feature is "target protection" via a tip guard or a sleeve to cover the end of a weapon, foil, epee, or saber (all defined below).

Highlights of an Auxiliary Frame (Shown in FIG. 5B): (1) The frame has a weapon mounted on it (on left) along with a target and an enhanced agility-training device (including an accelerometer) set to "target" mode. Such a target combination uses sound to note it should be touched. When touching the frame with a weapon (i.e., a foil, epee, or saber), an accelerometer (associated with a frame-mounted target and agility-training device) detects it has been jostled and triggers the agility-training device using the impact-generating mechanism. (2) The frame depicts—on the right as shown in FIG. 5B—an example of a single target mount without an agility-training device attached to it. This example (at the right) is used with a target requiring such target to be "hit" by the athlete.

Highlights of Target and Associated Agility-Training Device Mounted on a Tripod: (1) Tripod-mounted embodiments of the present subject matter are used in connection with a target and its attached enhanced agility-training device, in "Homebase" or "Homebase2" mode, where a tripod-mounted device "sees" an athlete moving out of, or through, a beam from a motion-detecting device that "triggers" the agility-training device when an athlete begins a drill. (2) Other tripod-mounted embodiments are used in connection with a target and its attached enhanced agility-training device, in "Target Test" mode, in which an athlete, as soon as light from a light-emitting device is detected, starts a predetermined exercise routine immediately because the enhanced agility-training device triggers immediately on light detection. This mode does not use the accelerometer or motion detector. (3) Still other tripod-mounted embodiments used in connection with a target and its attached enhanced agility-training device in "Target" mode, typically are used in situations where the motion-detecting device might be located behind the athlete (where a lit target cannot be seen but can be heard due to its audible sound emission).

A Training Set According to the Present Subject Matter Could Include: (1) A frame. (2) A frame along with one or more tripods. (3) A primary frame along with one or more auxiliary frames equipped with a weapon such as a foil, an epee, or a saber. (4) A primary frame along with one or more auxiliary frames equipped with such weapon further including one or more tripods. (5) Another example includes two or more tripods that individually or collectively could include an auxiliary frame having a single target location.

An Agility-Training Device According to Present Subject Matter Could Include: (1) Motion-detecting beam in "Homebase," "Homebase2," or "Target" mode with or without a sound-notification device. (2) Accelerometer used in "TargetBeat" and/or "TargetPress" mode with or without sound notification. (3) Clip-twist mechanism adapted and configured to keep part of a solenoid surface in overlaying contact over a housing including an aperture. (4) Display showing mode, battery status, etc. (5) Charge or Software update port. (6) "Mode" selection. (7) "On"/"Off" switch. (8) Power/Battery. (9) Solenoid to trigger.

BRIEF DESCRIPTION OF THE FIGURES

FIG. 4A depicts the student in a weapon-lunging position, when prompted by a system of the present subject matter. In order to describe the present subject matter in detail, the term "weapon" shall be understood to mean a "foil" (a long, thin, pointed fencing sword having a button on its point to prevent injury), an "epee" (a sword, especially a thin, pointed sword without a cutting edge, resembling a foil but heavier and more rigid, used in fencing; also spelled épée with an "acute accent" diacritical mark over the first and third letters), a "saber" (in fencing, a type of weapon, heavier than a foil, used with a slashing as well as thrusting movement: a touch may be scored by an edge or point), and the like.

FIG. 29 depicts another student in a weapon-lunging position, when prompted by a system of the present subject matter to do so. As noted above, the term "weapon" shall be understood in this patent specification to mean a "foil" (a long, thin, pointed fencing sword having a button on its point to prevent injury), an "epee" (a sword, especially a thin, pointed sword without a cutting edge, resembling a foil but heavier and more rigid, used in fencing), a "saber" (in fencing, a type of weapon, heavier than a foil, that is used with a slashing, thrusting movement: a touch may be scored with an edge or point), and the like.

Similar reference numerals shall be used throughout the drawing figures and the detailed description, below, to refer to similar components of the present subject matter.

DETAILED DESCRIPTION

Without causing an athlete to be distracted, break stride, negatively affect follow through, or lose concentration, the present subject matter, when operative, can be used to accurately determine amount of time it takes an athlete to move between two positions.

While the present subject matter is a tool that can be adapted and configured to help amateur and professional athletes improve their athletic skills, current embodiments of the present subject matter were adapted and configured primarily for student athletes.

In addition to fencing-activity embodiments presented in this patent specification, the present subject matter—in other embodiments designed to improve athletic skills relating to an assortment of other sporting events, e.g., tennis and/or volleyball activity—can be used to determine and reduce an amount of time needed by an athlete to move from a first position to a second position, and can next be used to reduce the time needed by the athlete to jump from the second position to a third position, e.g., in relation to a net.

Figure 30:
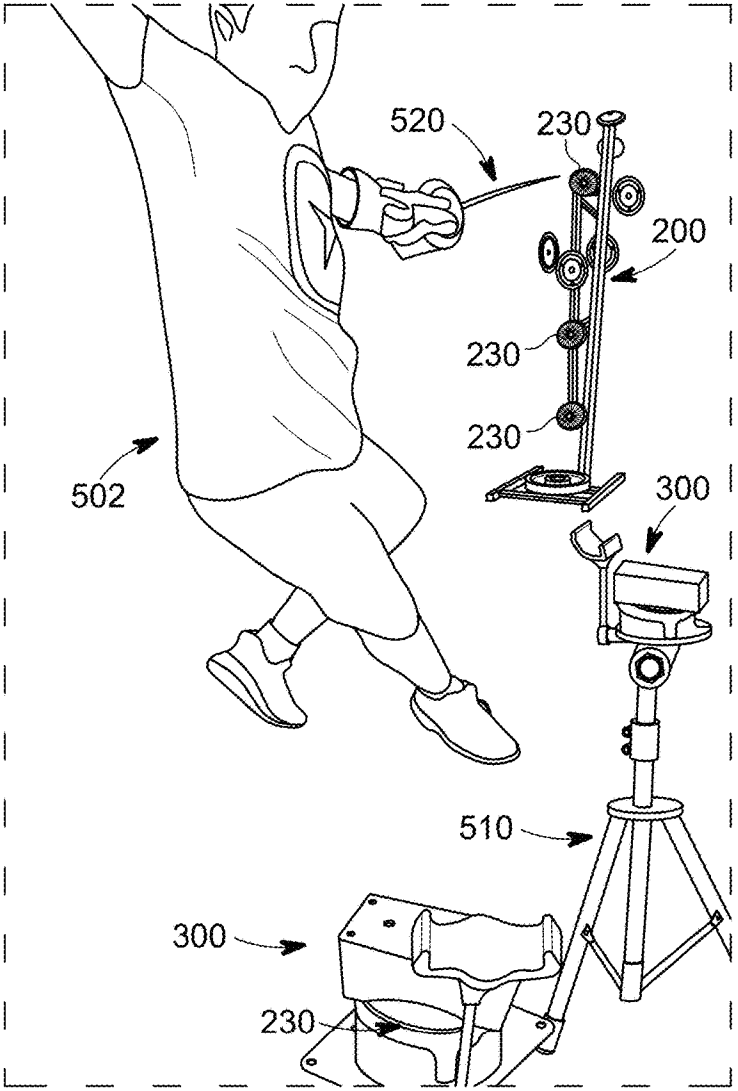
FIG. 30 presents the student shown in FIG. 29 in a retreating motion, after starting a drill and thereafter experiencing a target alert by a buzzer to retreat to the next position.
Figure 29:
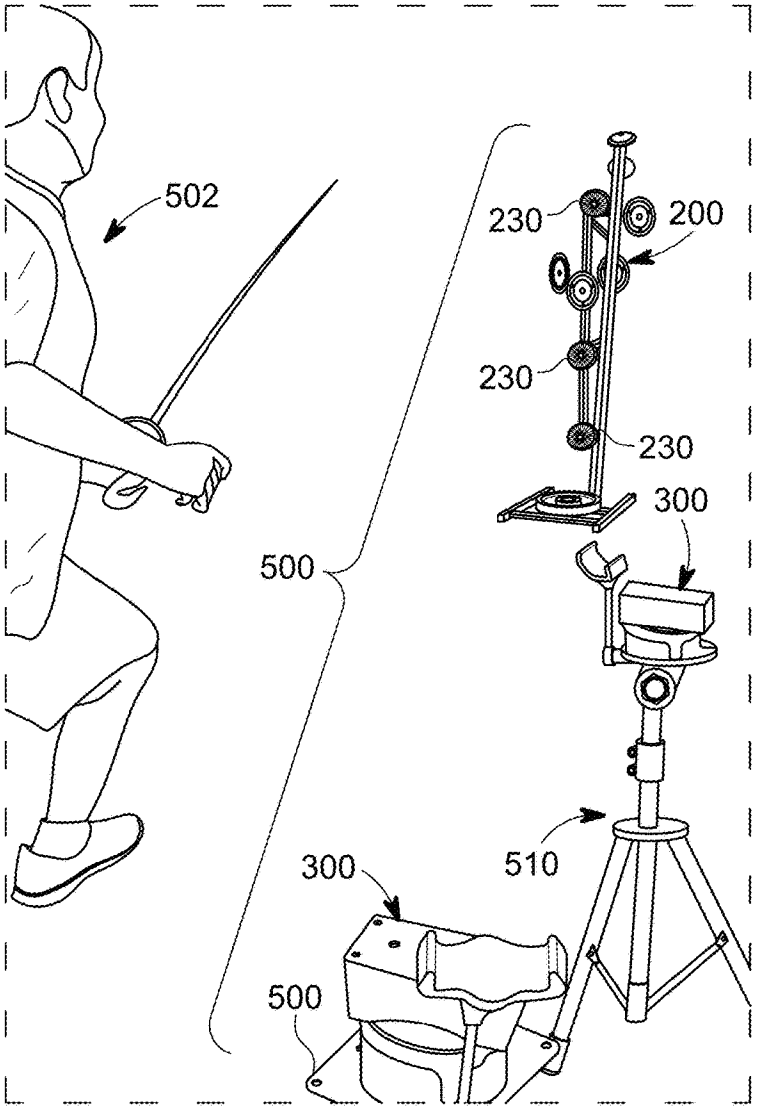

For instance, FIGS. 29 and 30 depict a fencing student using a saber (in fencing, a type of weapon, heavier than a foil, used with a slashing as well as thrusting movement).

Figure 1:
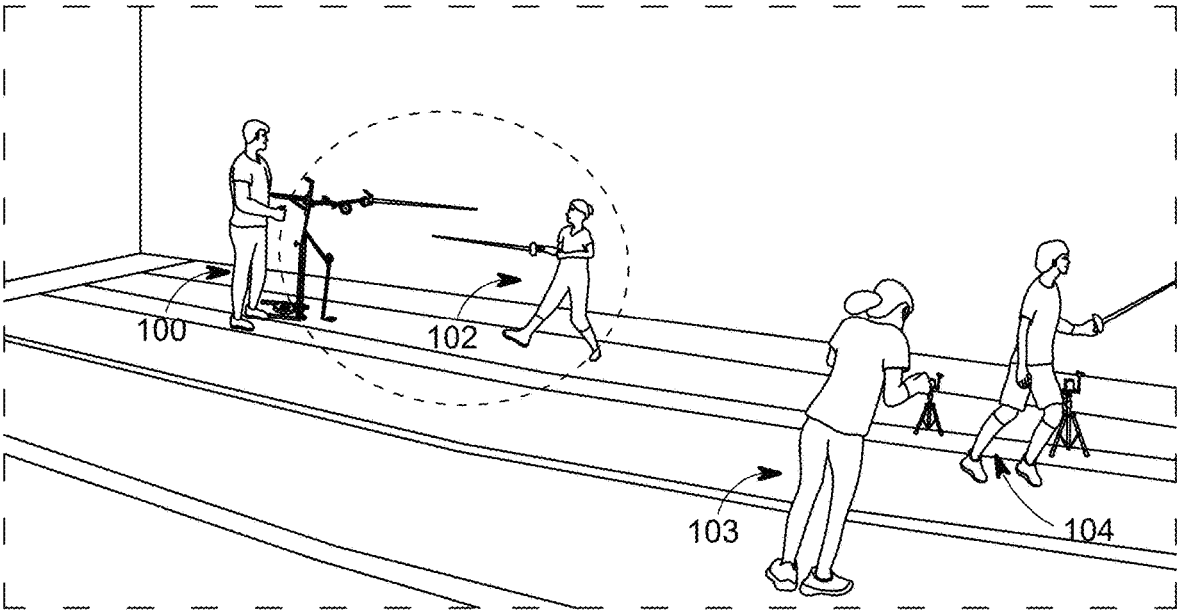
FIG. 1 depicts an area where fencing students learn a variety of skills for this sport.

Referring initially to FIG. 1, an exemplary walled-off area of an athletic facility used to teach fencing skills is shown. FIG. 1 depicts a student instructor 100. Also shown are a first fencing student 102, a second fencing student 103, and a third fencing student 104.

Figure 2:
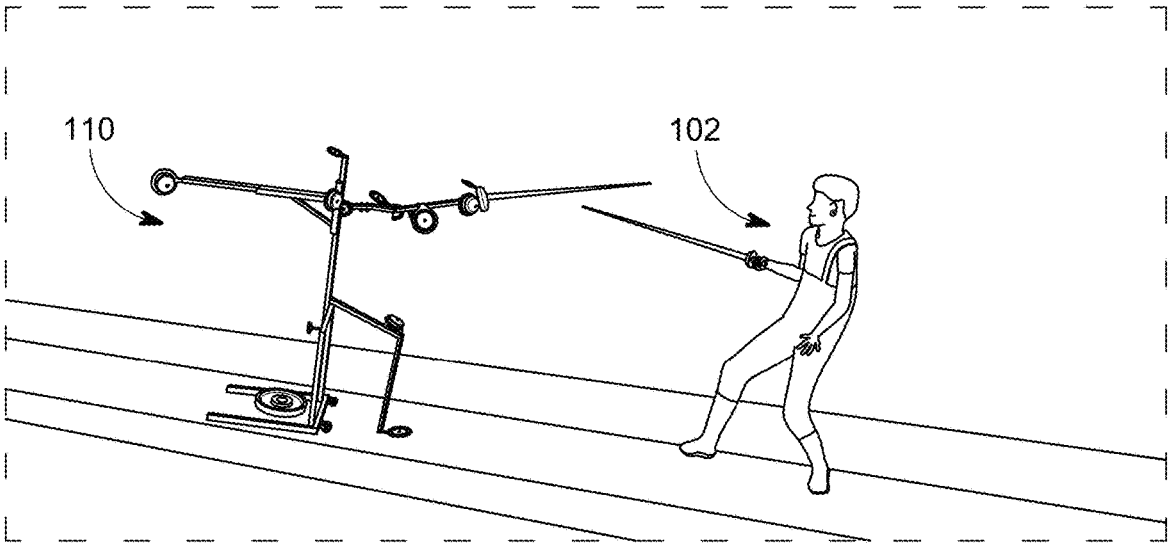
FIG. 2 shows a student, engaging an embodiment of a fencing-skills agility-training interactive system of the present subject matter, on a scale greater than shown in FIG. 1.
Figure 3:
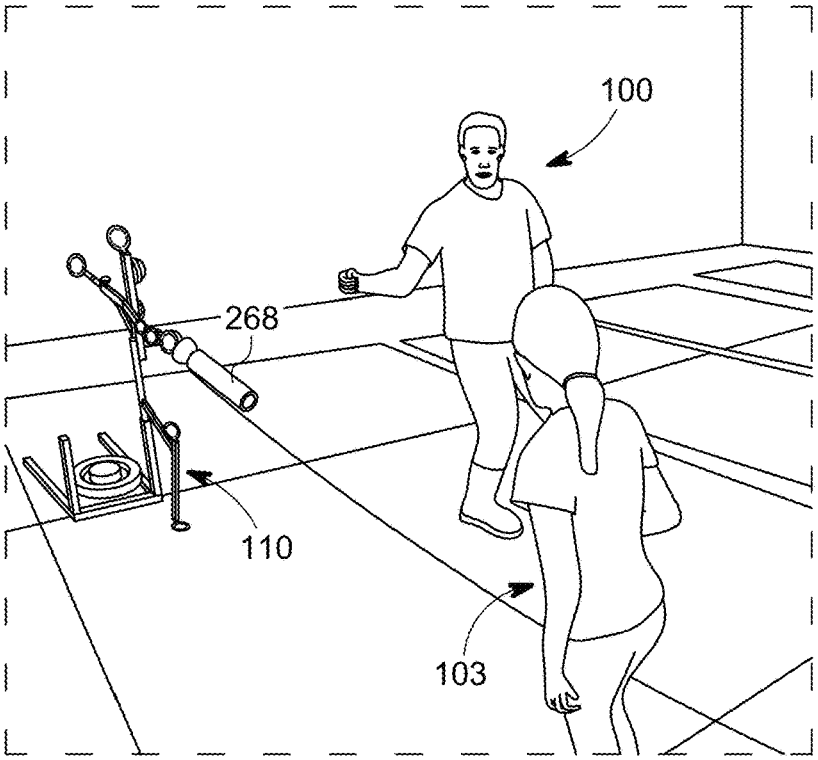
FIG. 3 depicts a student and an instructor on an enlarged scale relative to FIG. 1.
Figure 4:
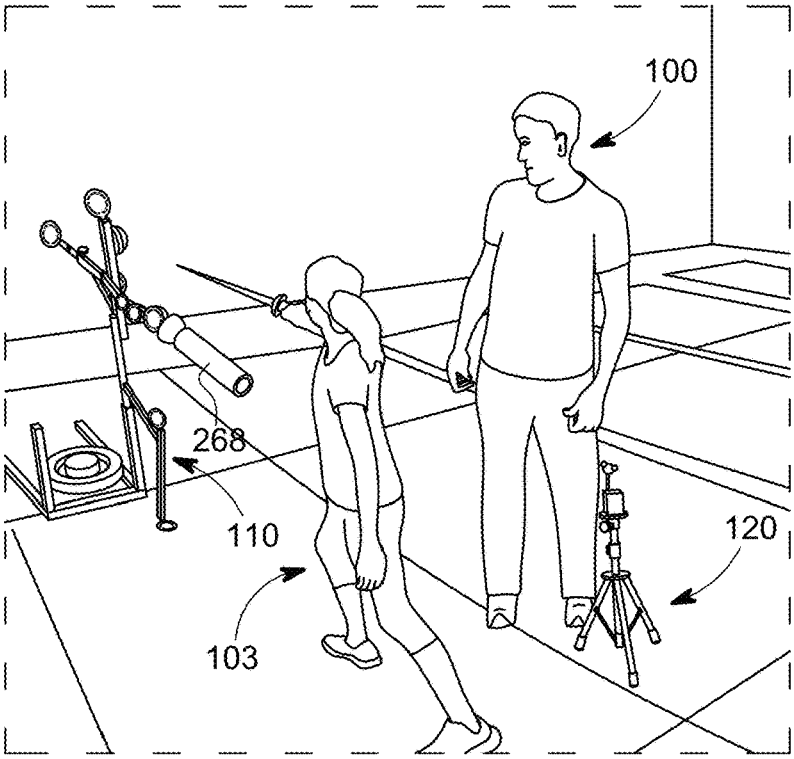
FIG. 4 presents the student of FIG. 3 "lunging forward" toward the embodiment shown in FIG. 1, which now reveals a second embodiment of the present subject matter.

FIG. 2 presents the first student 102 engaging an embodiment of a fencing-skills agility-training interactive system 110 of the present subject matter on an enlarged scale relative to FIG. 1. FIG. 3 depicts the second student 103 and instructor 100 on an enlarged scale relative to FIG. 1. Also, FIG. 4 depicts the second student 103 in the act of "lunging toward" the fencing-skills agility-training athlete-interactive system 110, thereby revealing a second embodiment of an athlete-interactive system 120 of the present subject matter.

Figure 3A:
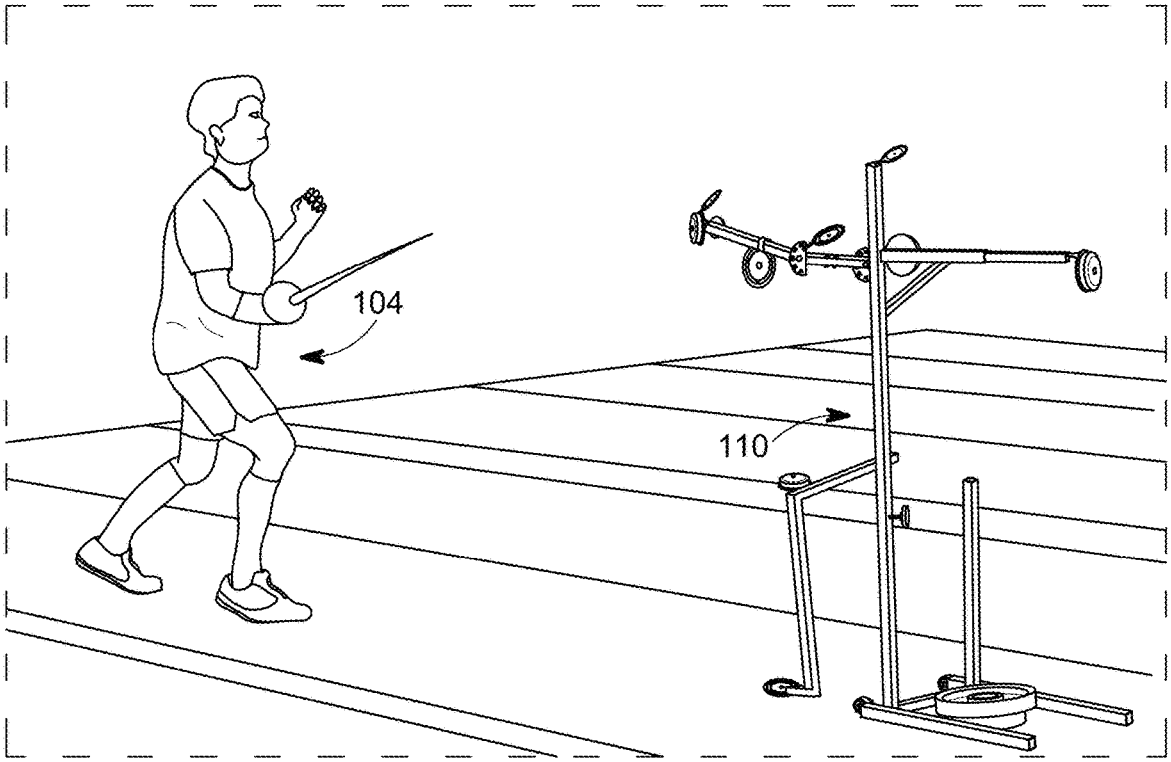
In FIG. 3A, another student facing another embodiment of a fencing agility-training interactive system of the present subject matter, is depicted in a "ready-to-lunge" position.
Figure 4A:
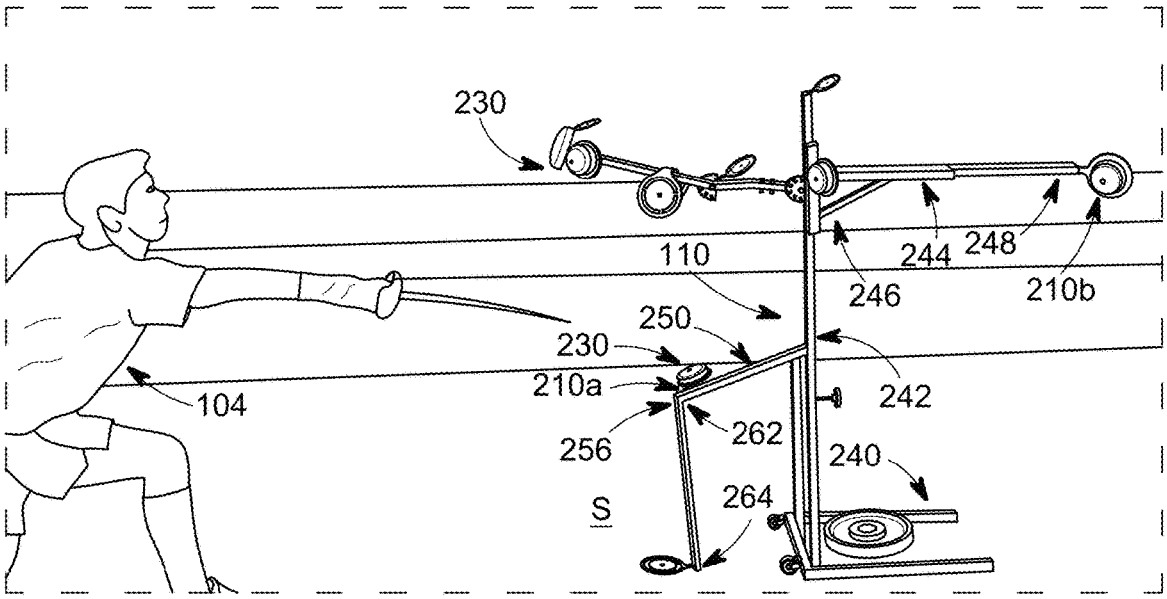

FIG. 3A presents the third student 104 facing the embodiment of the fencing-skills agility-training athlete-interactive system 110 (shown in FIG. 1). FIG. 3A presents the third student 104 in a "ready-to-lunge" position. Moreover, FIG. 4A shows the third student 104 in a "foil-lunging" position, after being prompted by a device mounted on the system 110.

Figure 5:
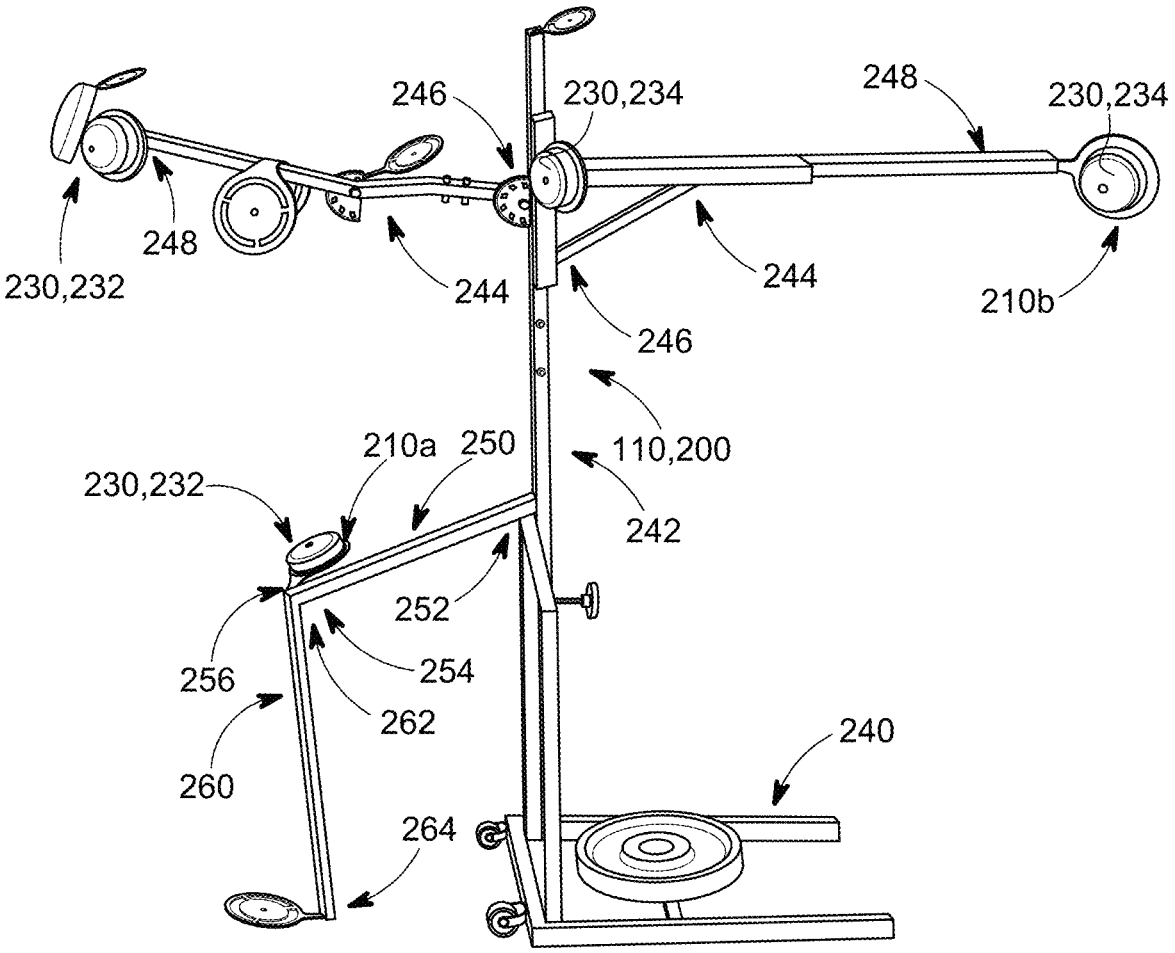
FIG. 5 shows elements of an agility-training system of the present subject matter.
Figure 6:
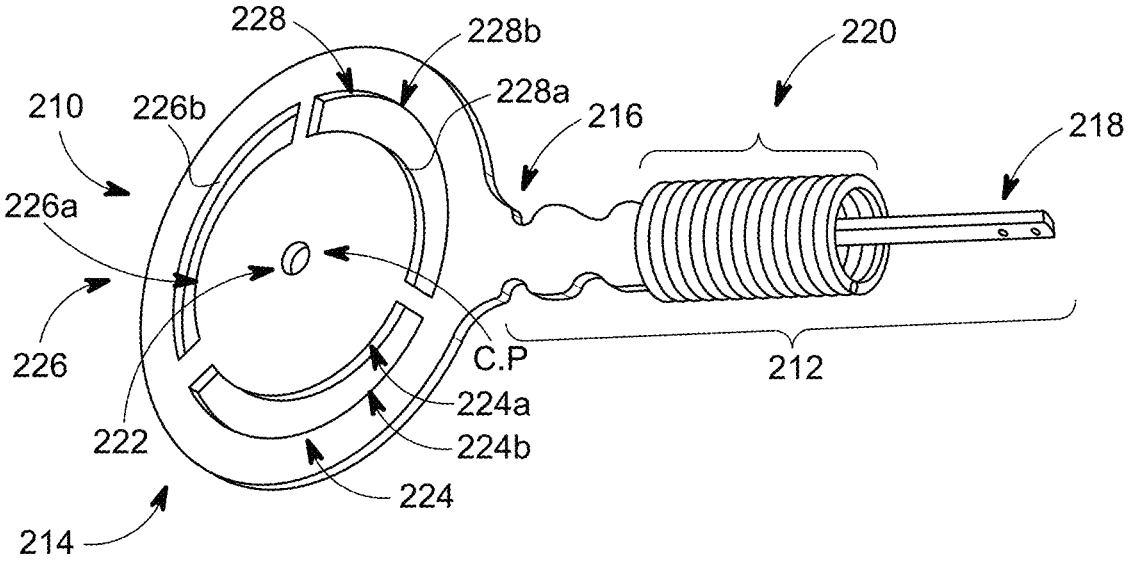
FIG. 6 shows an embodiment of a twist-mount component of the system of FIG. 4.

FIG. 5 shows the fencing-skills agility-training athlete-interactive system 110 of the present subject matter (shown in FIG. 1 on a reduced scale). The system 110 includes a frame 200 and a plurality of mounting plates 210, each of which is removably secured to a corresponding mounting position on the frame 200, In addition, the frame 200 includes at least one athlete agility-training (or athlete reaction-training) device 230 removably secured to an associated mounting plate 210. The illustrated embodiment of the mounting plate 210, which can be made of made of steel, includes a shank portion 212. The mounting plate shank portion 212 extends from a device-mounting portion 214 of plate 210. In this embodiment, the device-mounting portion 214 is planar and essentially circular. One end portion 216 of shank 212 is unitary with a peripheral-edge portion of the substantially circular and planar device-mounting portion 214. Sandwiched between the one end portion 216 and an opposite end portion 218 of the shank 212 is a spring-biased joint 220. The end portion 216 has its own opposite end portion; and the other end portion 218 also has its own opposite end portion. (FIG. 6.) The spring-biased joint 220 is securely joined to the opposite end portions of each of the end portions 216 and 218 of shank 212.

In embodiments where the mounting plate 210 is planar, such a planar mounting plate 210, shown (in FIG. 6) as including four apertures (222, 224, 226 and 228), shall be described as including at least three apertures (222, 224 and 226) through mounting plate 210, for purposes of "tracking" the apertures (222, 224, and 226) in the appended claims.

FIG. 6 depicts a planar mounting plate 210 defining at least three apertures 222, 224, and 226 through mounting plate 210. One aperture 222 of the at least three apertures 222, 224, 226 is centrally located on the mounting plate 210. Each of the other two 224, 226 of the at least three apertures 222, 224, and 226 provides the mounting plate 210 with a pair of spaced-apart interior sidewalls 224*a* and 224*b* (for aperture 224) and 226*a* and 226*b* for aperture 226. One sidewall 224*a* of the spaced-apart pair of sidewalls 224*a*, 224*b* for aperture 224 and one sidewall 226*a* of the spaced-apart pair of sidewalls 226*a*, 226*b* for aperture 226 are each radially spaced from a center point (C.P.) of the centrally located aperture 222. The other sidewall 224*b* of the spaced-apart pair of sidewalls 224*a*, 224*b* for aperture 224 and the other sidewall 226*b* of the spaced-apart pair of sidewalls 226*a*, 226*b* for the aperture 226 are each helically spaced from the C.P. (center point). Another embodiment of centrally located aperture 222*a* is shown in FIG. 28. As a result, the mounting plates 210 (FIG. 6) and 210*a* (FIG. 27) each function as "twist-to-secure" structures for mounting various devices of the present subject matter to plate 210 or 210*a*.

As noted above, the embodiment of planar mounting plate 210 (FIG. 6) and 210*a* (FIG. 27) includes a fourth aperture 228 through planar mounting plate 210, essentially identical to the second and third apertures 224, 226 described above. The fourth aperture 228 provides mounting plate 210, 210*a* with a pair of spaced-apart interior sidewalls 228*a*, 228*b* (to define aperture 228). The sidewall 228*a* is radially spaced from the center point (C.P.) of centrally located aperture 222 and sidewall 228*b* is helically spaced from the C.P.

Figure 5A:
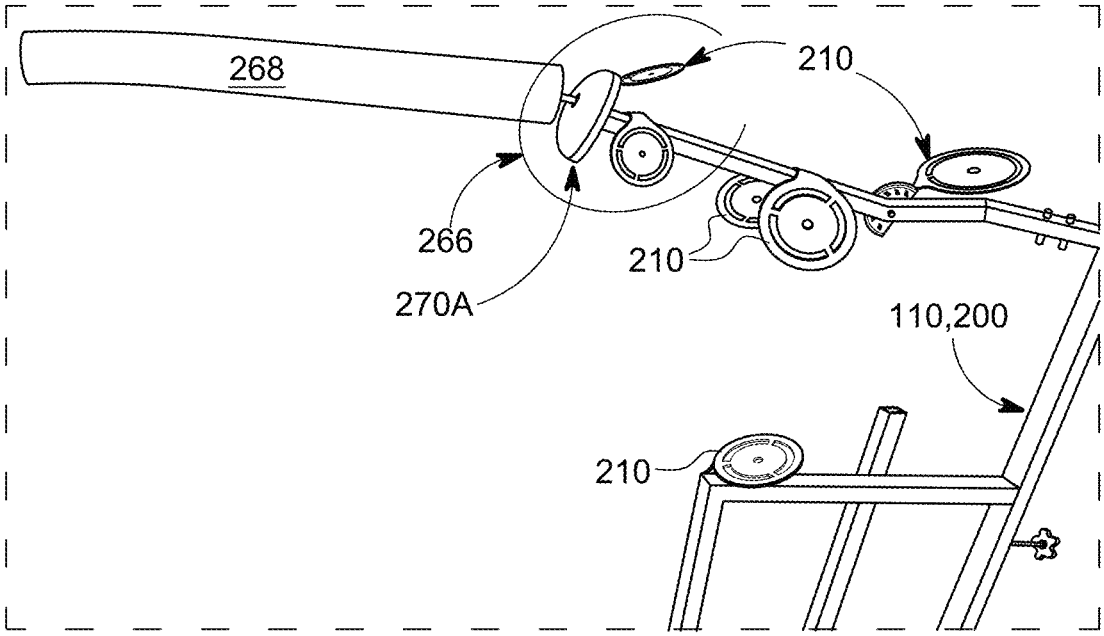
FIG. 5A illustrates additional components used with the system depicted in FIG. 5.

FIG. 5A presents a closer view of the system 110 and frame 200 (shown in FIG. 5) as well as several of the essentially circular and planar mounting plates 210 securely mounted on the frame 200. Also shown in FIG. 5A—within a "target area" 266—are a cylindrical cushion 268, a guard 270A, and one of the mounting plates 210. The cylindrical cushion 268, about 76.2-101.6 millimeters (3-4 in.) in diameter, preferably made of flexible polyethylene foam, has a central opening to receive a length of a "weapon" (not shown). To describe the present subject matter, in detail, the term "weapon" shall be understood throughout this patent specification to mean a "foil" (a long, thin, pointed fencing sword having a button on its point to prevent injury), an "epee" (a sword, especially a thin, pointed sword without a cutting edge, resembling a foil but heavier and more rigid, used in fencing; also spelled épée with an "acute accent" diacritical mark over the first and third letters), a "saber" (in fencing, a type of weapon, heavier than a foil, used with a slashing as well as thrusting movement: a touch may be scored by an edge or point), and the like. In certain situation, the foam is not entirely "filled" by a length of a "weapon" but rather intentionally left partially filled so that students may safely run into the foam and not injure themselves, which enables students to train without needing to wear full protective gear. In this case, the "fill" material is a length of polyvinyl chloride ("PVC") pipe about 1-ft. long.

Figure 5B:
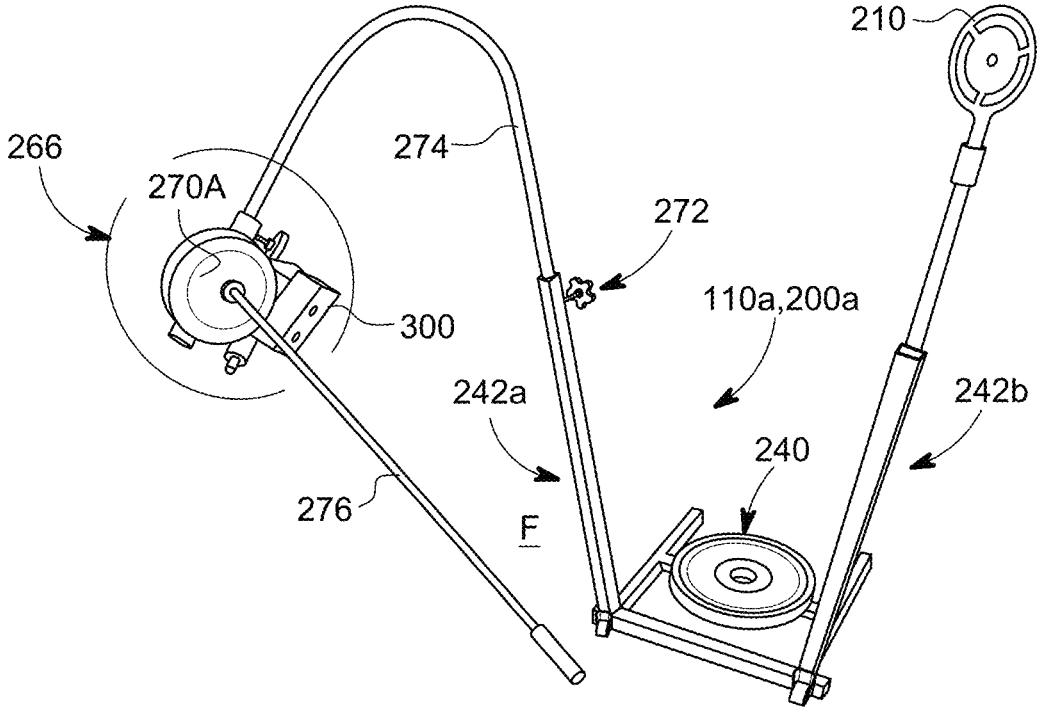
FIG. 5B presents yet another agility-training system of the present subject matter.

FIG. 5B shows another system 110A and frame 200A of the present subject matter. Frame 200A has a planar base 240 (FIG. 5) and includes a first vertically oriented member 242A and a second vertically oriented member 242B spaced from first vertically oriented member 242A. Both vertical members 242A, 242B are securely fixed to planar base 240.

For system 110A (FIG. 5B) an enhanced athlete-interactive agility-training device 300 includes an accelerometer to detect when anything in the target area 266 including but not limited to the guard 270A, epee 276, or the training device 300 is sharply jostled. In addition, when the enhanced athlete-interactive agility-training device 300 includes an accelerometer, the athlete-interactive agility-training device 300 will detect motion when any portion of the epee 276 is jostled, even when protected by the cushion 268 (FIG. 5A).

Turning now to embodiments shown in FIGS. 5A and 5B, whenever an enhanced athlete-interactive agility-training device 300 (containing an accelerometer) is secured to a mounting plate 210 in target area 266, the operational functionality of the accelerometer includes: (1) a "beat" mode which is adapted and configured to "trigger" (react and also save data) when the cushion 268 on a "target" foil, epee, or saber has been jostled or moved sharply) and (2) a "press" mode which is adapted and configured also to trigger when a cushion 268 has been moved aside—slightly—by a student's foil, epee, or saber.

Vertical member 242A is hollow. An upper portion of vertical member 242A includes a hand-operated threaded mechanism 272. The frame 200A of system 110A includes an elongated arched arm 274, an end portion of which is designed, sized, and configured to extend into the hollow portion of the vertical member 242A. The hand-operated threaded mechanism 272 is adapted and configured to securely fix the end portion of the elongated arched arm 274 effectively within the hollow portion of vertical member 242A, as shown in FIG. 5B. Note that an enhanced athlete-interactive agility-training device 300 has been mounted to a mounting plate 210 in target area 266. Fixed to and extending from guard 270A is a length of foil or epee or saber 276 over which a student must learn to master.

Hand-operated threaded mechanism 272 is used to extend arched arm 274 from vertical member 242A to increase a distance between target area 266 and floor ("F") or may be used to retract a portion of arched arm 274 into vertical member 242A to decrease a distance between target area 266 and floor ("F"). The other vertical member 242B may have a mounting plate 210 secured to an end portion thereof and may include extendable and retractable components to raise or lower mounting plate 210 relative to the floor. Beginner fencing students may practice with one such system 110A and frame 200A. Intermediate fencing students may practice with two such systems 110A, frames 200A. Enhanced students may practice with three or more such systems 110A and frames 200A.

Figure 5C:
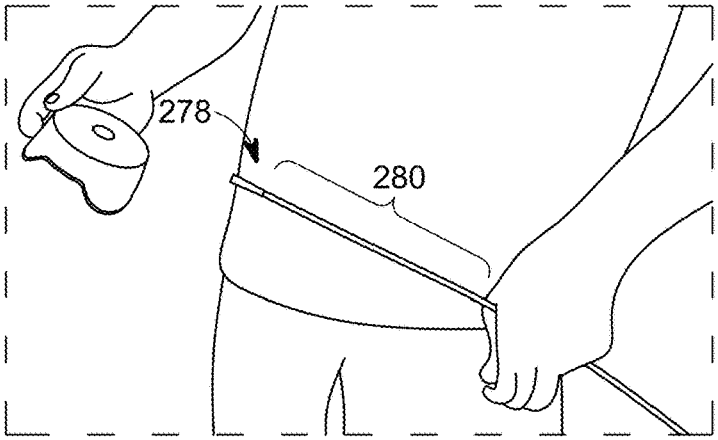
FIGS. 5C, 5D, and 5E present optional components of the present subject matter.
Figure 5D:
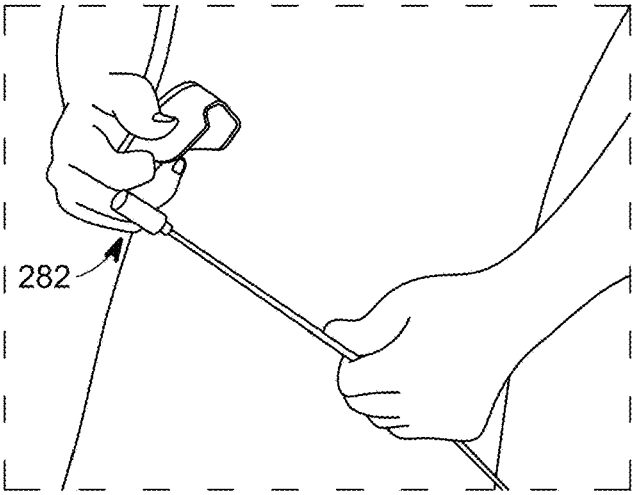
Figure 5E:
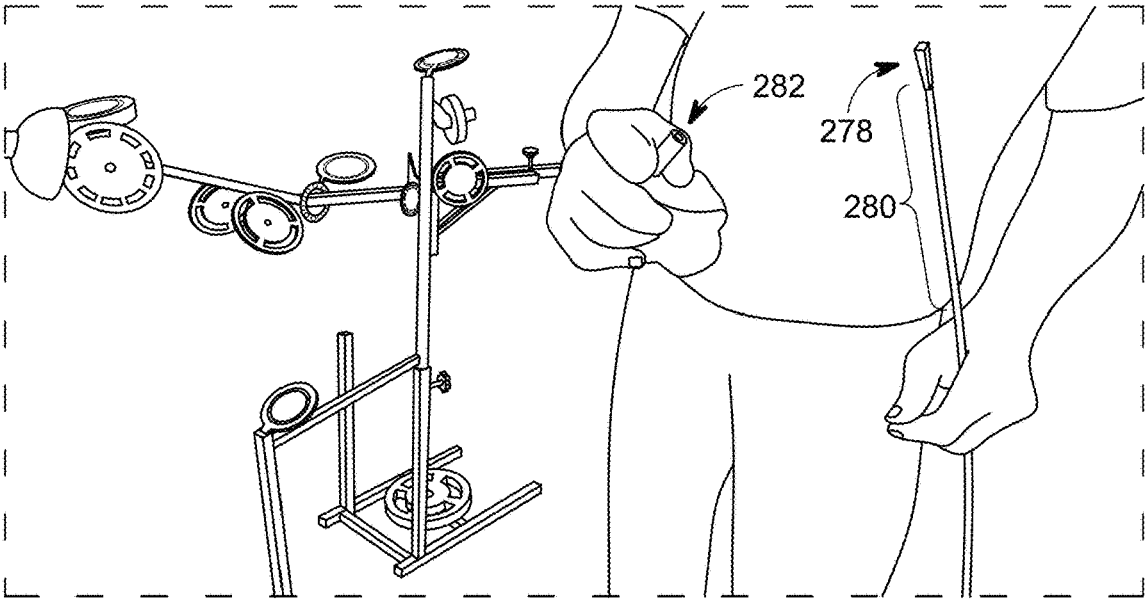
Figure 7:
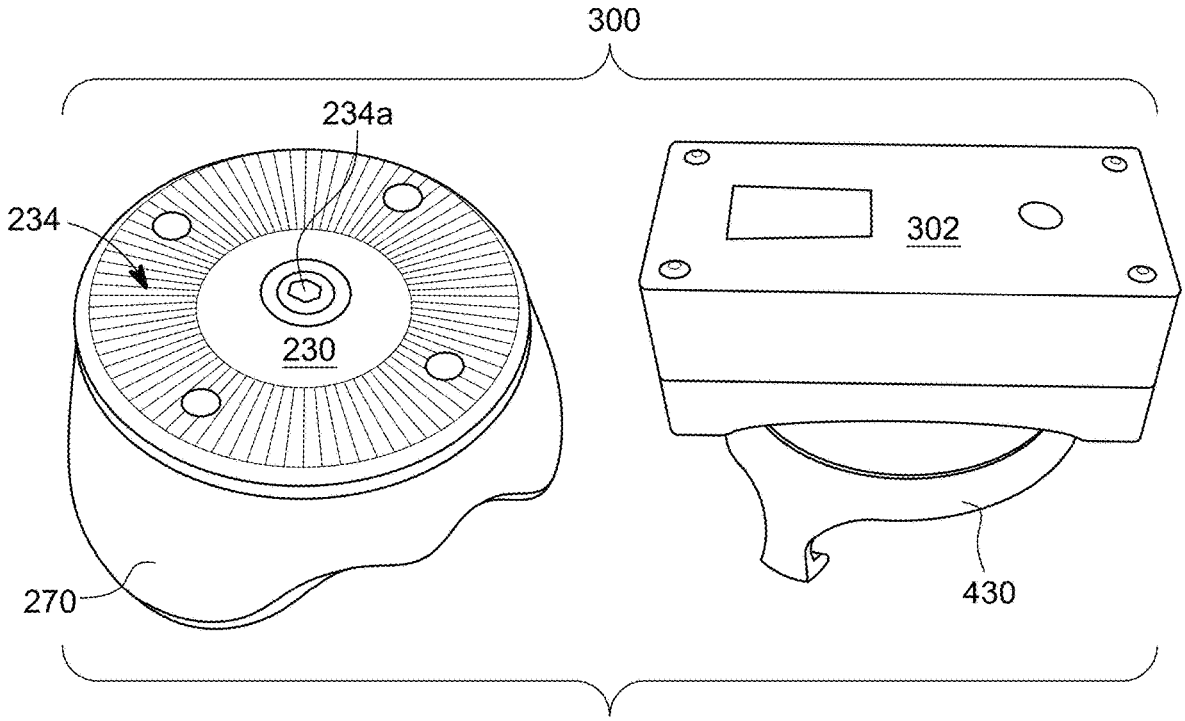
FIG. 7 is an exploded perspective view of several additional system components.

Various embodiments of the agility-training device 300 described in this patent specification include a light-emitting device 232 (see, e.g., FIGS. 5 and 7) having an impact-sensitive surface 234 (again please see, e.g., FIGS. 5 and 7) that is operatively connected to the light-emitting device 232. In operation, the light-emitting device 232 ceases its light emission when its impact-sensitive surface 234 is "tapped" (i.e., struck or impacted)—for example—by a blunt end 278 (see, e.g., FIGS. 5C and 5E) of a different foil, epee, or saber 280, an end portion of which is held by a fencing student or instructor.

The surface 234 (FIG. 7) of an athlete agility-training reaction-training device 230 (FIG. 5) includes a central portion called a "charge ring" 234A (FIG. 7) that, when "tapped" or jostled, triggers the light-emitting device 232. Also—since the charge ring 234A may undergo damage when sufficiently forcefully impacted by the blunt end 278—a foil, epee, or saber tip 282 made of commercially available impact-dampening material is designed, sized, adapted, and configured to be snuggly retained on the blunt end 278 of a foil or epee or saber 276, 280. The device 230 includes an internal sensor adapted to sense changes in the "z direction," specifically, "normal to" (i.e., perpendicular to) the surface 234 of an agility-training device 230. Thus, impacts to training device 230 are detected—but are not necessarily "triggering events"—unless such impact exceeds a predetermined impact-limit value. Therefore, other embodiments of the present subject matter may include "Beat" mode and/or "Press" mode, either of which is adapted n configured for enabling the internal sensor to trigger a training device 230 whenever a lateral "impact" or "strike" occurs. Also please note: While a "charge ring" 234A (FIG. 7) may be tapped, its primary purpose in this embodiment of the present subject matter is to enable athlete agility-training reaction-training devices 230 to be stacked seriatim, each atop another for purposes of electrically charging them all when the stack is placed on a charging platform.

Frame 200 (FIG. 5) includes planar base 240 and an extendable-and-retractable vertically disposed member 242 (FIG. 5) removably secured to the planar base 240. The frame 200 also includes at least one arm 244 having a first end portion 246 removably secured to the vertically disposed extendable-and-retractable member 242. Each arm 244 includes a second end portion 248 spaced from the first end portion 246. The second end portion 248, which extends from the frame 200, in embodiments is preferably made of a hollow cylindrical (e.g., "tubular") noncorrosive material or metal. The entire length of the opposite end portion 218 (FIG. 6) of the integral shank 212 portion of the mounting plate 210 is adapted, configured, and dimensioned to be snuggly yet removably secured within the hollow portion of the arm 244 (FIG. 5) at the extended (i.e., second) end portion 248.

In embodiments, arms 244 are adapted and configured to enable each associated second end portion 248 (of its associated arm 244) to be extendable and retractable, within a hollow portion of its associated arm 244, relative to frame 200. In embodiments, the second end portion 248 of each arm 244 may have a mounting plate 210*b* fixed to its end portion 248 (FIG. 5). Frame 200 has an upper leg member 250 and an associated lower leg member 260. The upper leg member 250 is oriented toward an agility-training (or reaction-training) athlete (which, in embodiments, shows student athletes 102, 103, 104; see, e.g., FIGS. 1, 2, 3, 4, 3A, and 4A). The upper leg member 250 has a first end portion 252 removably secured to vertically oriented extendable-and-retractable member 242 and has a second end portion 254, including a knee 256, spaced from upper leg first end portion 252. A lower leg member 260 has a first end portion 262 fixed to knee 256 and a second end portion 264 spaced from first end portion 262. Lower leg second end portion 264 contacts a surface ("S") upon which student athlete 104 is shown in FIG. 4A.

As illustrated by the present embodiment of the agility-training athlete-interactive system 110 shown in FIGS. 4A and 5, at least one mounting plate 210*a* of a plurality of mounting plates is removably secured to the frame 200 adjacent to the knee 256. Or at least one other mounting plate 210*b* is removably secured to an arm 244 at its second end portion 248. Also, as shown in the embodiment of the athlete-interactive system 110 presented in FIGS. 4A and 5, the base 240 has a planar surface sized, adapted, and configured to support and retain a predetermined amount of mass placed thereon. During athletic activity an amount of mass could be a 25-pound weight, or could be substantial, such as a 100-pound weight, often used by heavy-weight lifters and/or professional body builders. Embodiments of interactive system 110 (FIGS. 3A, 4A, and 5) include a plurality of mounting plates 210 (FIGS. 6, 27), each of which is removably secured to frame 200.

As shown in FIGS. 3A, 4A and 5, the athlete agility-training interactive system 110 of the present subject matter has at least one athlete-agility, reaction-training device 230 removably secured to and associated with one or more of the mounting plates 210. In embodiments where an athlete is a student athlete involved in fencing activity, each agility-training reaction-training device 230 includes its own light-emitting device 232 within its athlete-agility, reaction-training device 230. Each athlete-agility reaction-training device 230, that has been secured to the frame 200, also includes an impact-sensitive surface 234 operatively connected to its associated light-emitting device 232. During student-athlete agility-training fencing-activity sessions, the light-emitting devices 232 are designed to stop emitting flashes of light when associated impact-sensitive surfaces are impacted by a fencing student "tapping" an impact-sensitive surface 234, for example, by using a blunt end 278 of an epee, or a foil, or a forward thrust or cutting action of a saber.

The spring-biased joints 220 (FIG. 6), permit fencing students to strike the impact-sensitive surfaces 234 without damaging them. Each spring-biased joint 220 flexes, to dissipate substantially all impact force when an impact-sensitive surface 234 is struck.

Figure 27:
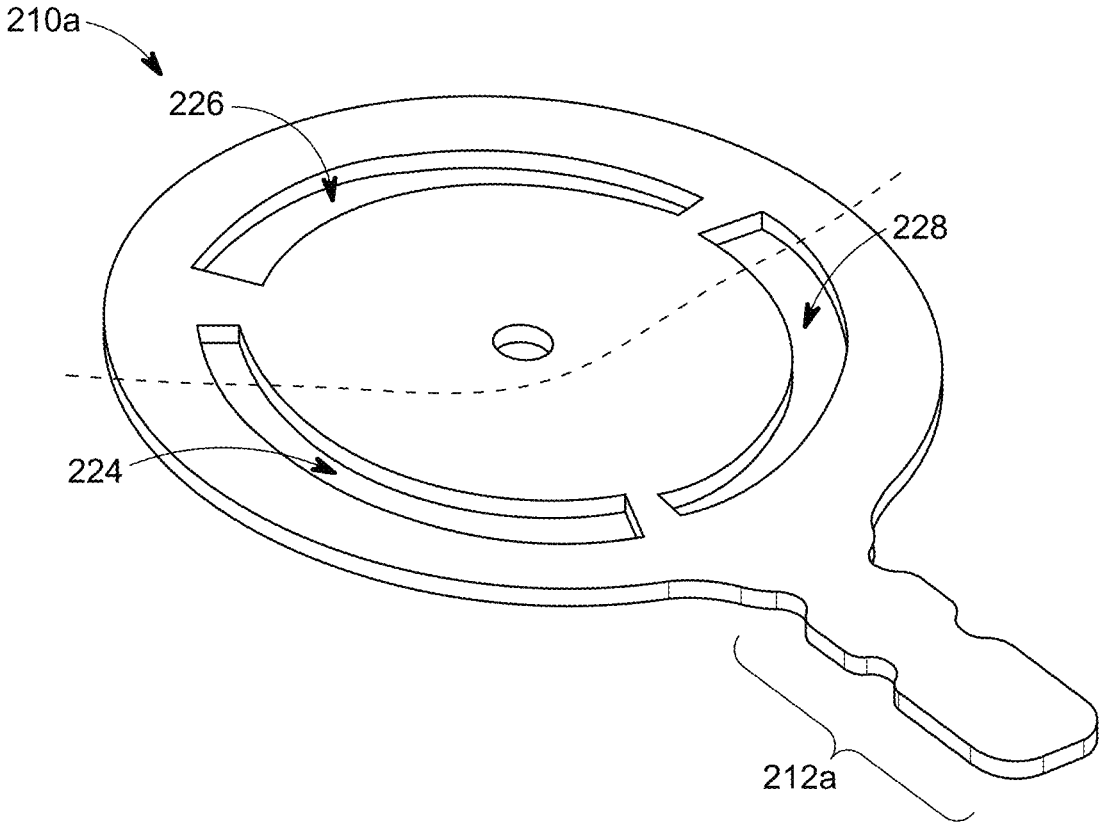
FIG. 27 shows another embodiment of a twist-mount component shown in FIG. 4.
Figure 28:
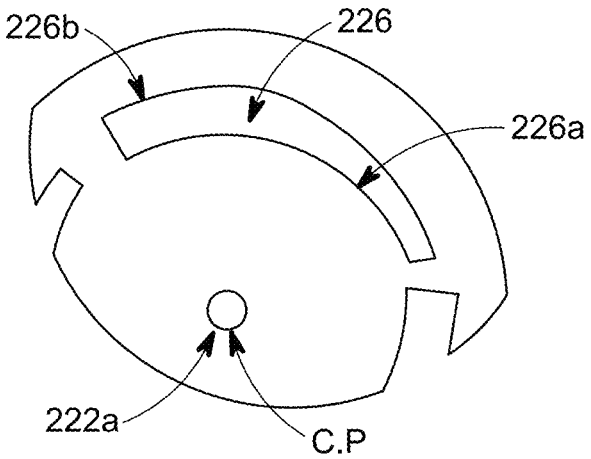
FIG. 28 presents a portion of a twist feature of the component depicted in FIG. 27.

FIG. 27 depicts another embodiment of a mounting plate 210*a* of the present subject matter. The embodiment depicted in FIG. 27 has a shorter and one-piece integral shank 212*a* (and lacks a spring-biased joint 220) as is shown in FIG. 6. A twist-mount feature of mounting plates 210 (FIG. 6) and 210*a* (FIG. 27) is depicted in FIG. 28, which is a plan view of a portion of the mounting plate 210*a* shown in FIG. 27. The twist-mount feature of the present subject matter may be described as follows. The light-emitting devices 232 each include two or more integral members that extend away from a main body portion of each such light-emitting device 232. Each light-emitting device 232 and its associated mounting plate 210 or 210*a* (to which it is removably secured) is adapted, configured, and dimensioned, relative to each other (mounting plate 210 or 210*a*) such that each of the two or more integral members extending from its light-emitting device 232 is insertable into and retractable from the other two of the at least three apertures 224, 226, and 228 depicted in FIG. 6. The end portions of each of the two or more members (of each light-emitting device 232) are adapted, configured, and dimensioned relative to the other two of the at least three apertures 224, 226, and 228 such that rotation of one of the light-emitting devices 232 and its associated mounting plate 210 (FIG. 6) or 210*a* (FIG. 27), relative to the other, about an axis disposed transverse to the mounting plate 210 (FIG. 6) or 210*a* (FIG. 27) and through the central aperture 222 (FIG. 6) or 222*a* (FIG. 28) either causes a light-emitting device 232 and its associated mounting plate to be removably joined together, when the two or more members of device 232 are inserted into the two of the at least three apertures 224, 226, and 228 of the plate, or causes the light-emitting devices 232 and the mounting plates 210 to be releasable from each other.

In embodiments, an athlete agility-training device 230 (FIGS. 4A, 5) includes a skirt-like structure 270 (please see FIGS. 7, 7A, 7B, 7C, 7D, 7E, and 7F) secured to the agility-training reaction-training device 230 along peripheral edge portions of the device 230. The skirt-like structure 270 (FIGS. 7, 8) includes peripherally equally spaced-apart extending edge portions 284, 286, and 288 (FIG. 7D), each of which is sized, adapted, and configured to be fitted into and removably secured to a respective one of the apertures 224, 226, and 228 (FIGS. 6, 27) of mounting plate 210, 210*a*. In embodiments, the skirt-like structure 270 and the peripherally equally spaced-apart extending edge portions 284, 286, and 288 (FIG. 7D), each unitary with skirt-like structure 270 (FIG. 7), is manufactured from preselected materials including rigid or flexible polymeric materials.

Figure 7A:
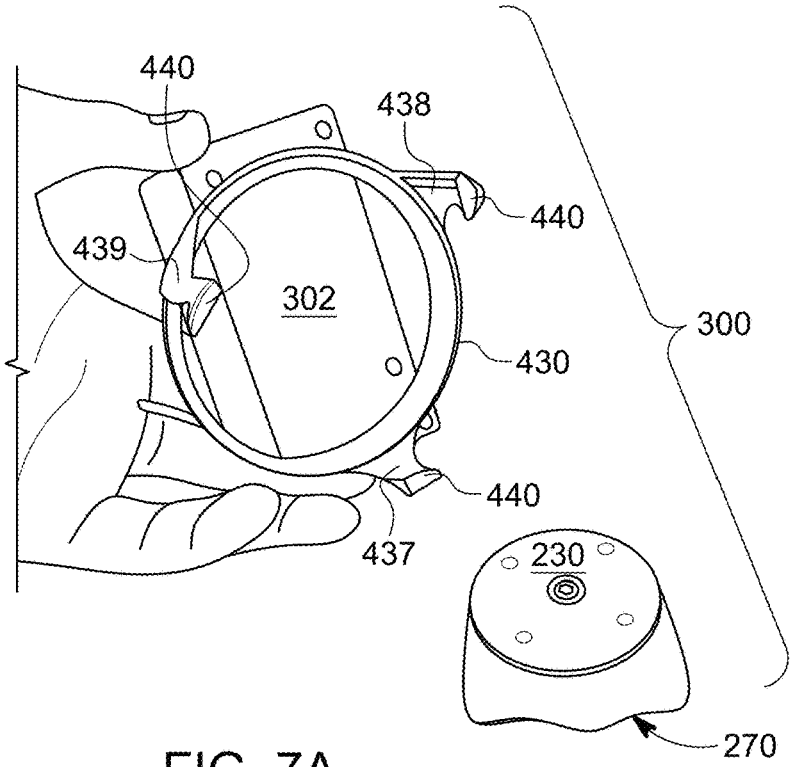
FIGS. 7A, 7B, and 7C depict attaching components of the present subject matter.
Figure 7B:
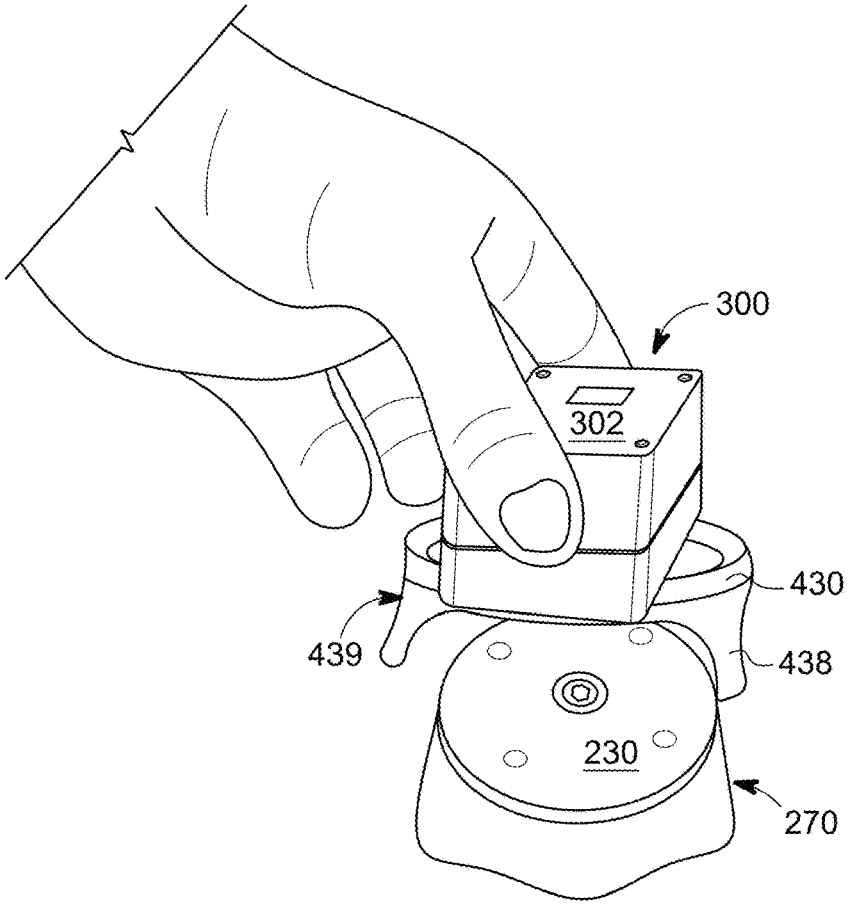
Figure 7C:
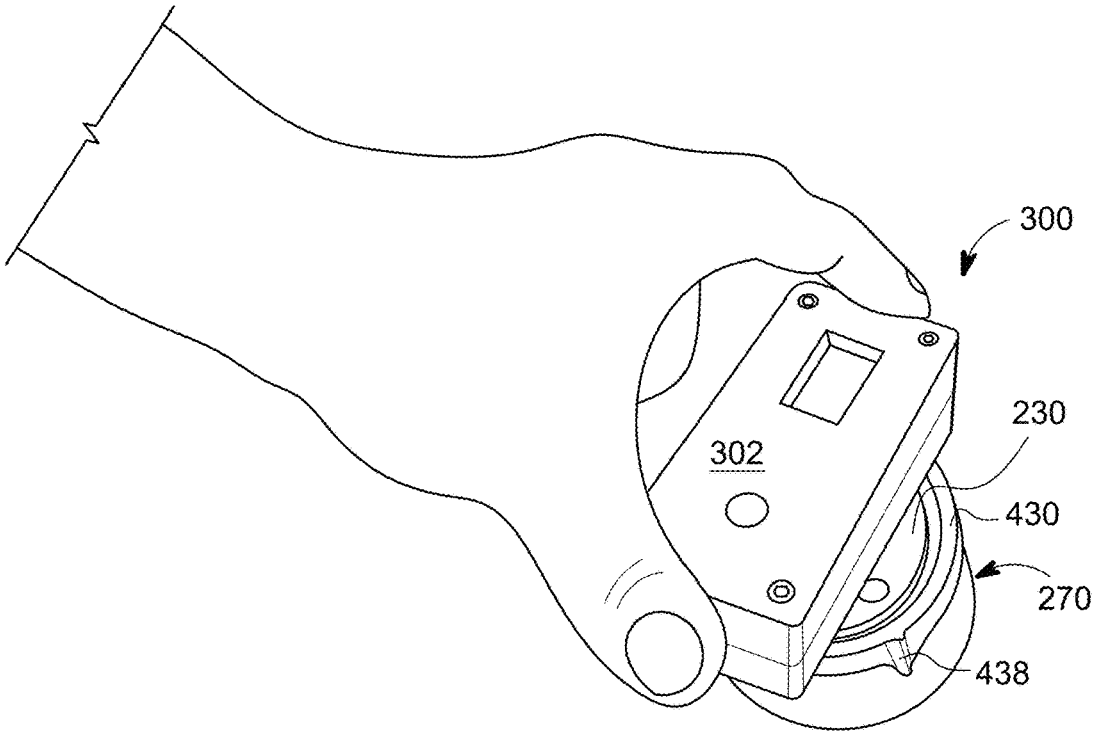
Figure 10:
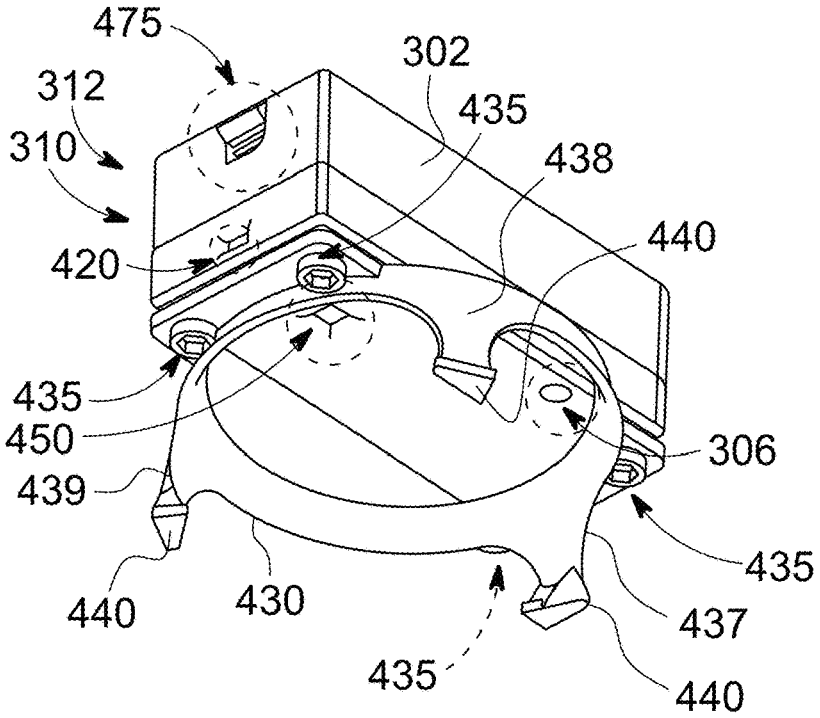
FIG. 10 presents two joined system components as an underside perspective view.
Figure 11:
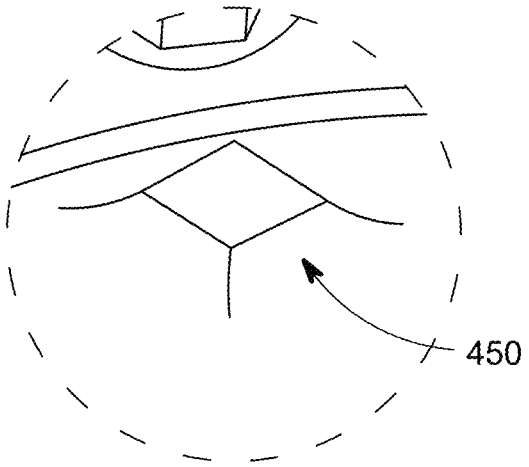
FIG. 11 presents a light-sensor feature—on an enlarged scale relative to FIG. 10.
Figure 12:
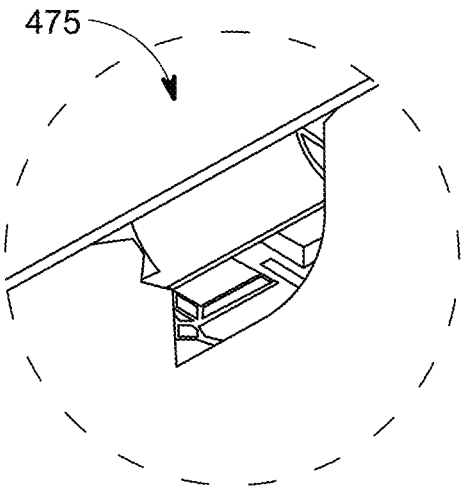
FIG. 12 presents a charge-port feature—on an enlarged scale relative to FIG. 10.

FIGS. 7A, 7B, and 7C sequentially depict how two components of the present subject matter were designed, adapted, and configured to be snap engageable together. An enhanced athlete-interactive agility-training device 300 of the present subject matter includes a housing 302. The housing 302 may be removably secured to a foundation, base, or pedestal 430 by a plurality of threaded fasteners 435 (FIG. 10). The foundation, base, or pedestal 430 includes three legs, 437, 438, and 439 (FIGS. 7A, 10, 23) unitary with the foundation, base, or pedestal 430. Each leg includes an integral foot 440. The feet 440 are adapted and configured to be snap engageable to the skirt-like structure 270.

To snap engage the athlete agility-training device 300 and the other training device 230 together, the feet 440 of the legs 437, 438, and 439 (of the enhanced agility-training device 300) are oriented toward the training device 230 (FIG. 7A). Next, the foundation, base, or pedestal 430 is moved adjacent to the circumference of the training device 230 (FIG. 7B). Lastly, the feet 440 are snapped over the upper edge portions of the skirt-like structure 270 (FIG. 7C) closely adjacent to the upper surface of the other training device 230 (FIG. 7) for holding the aperture opening 306 (FIGS. 10, 13) of the impact-generating mechanism 308 against the impact-sensitive surface 234 of the agility-training device.

Figure 7D:
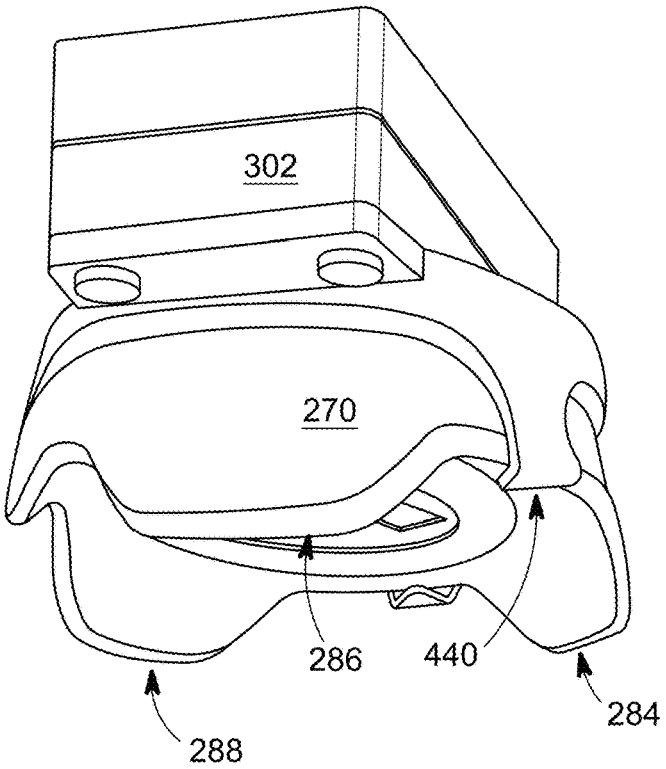
FIGS. 7D, 7E, and 7F depict separating components of the present subject matter.
Figure 7E:
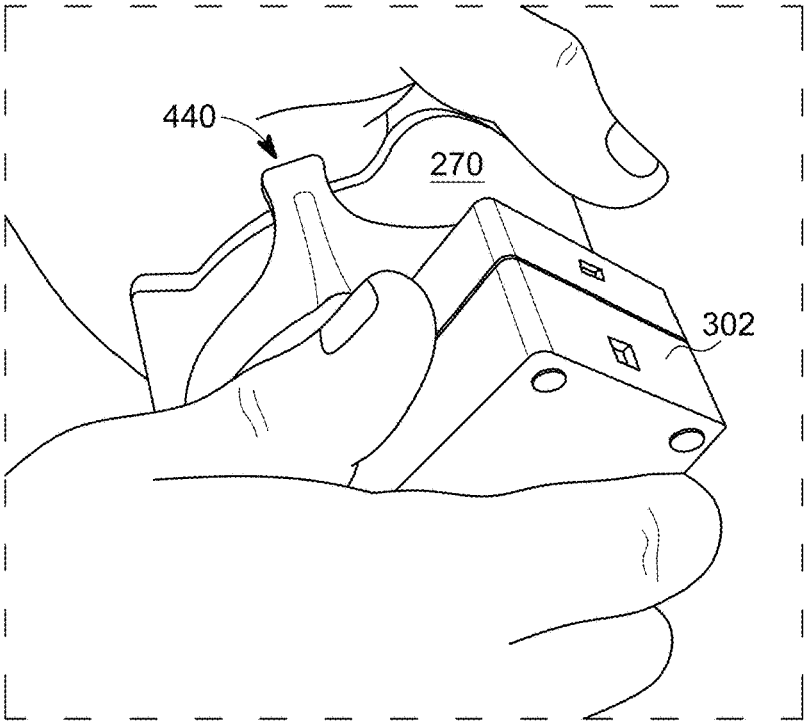
Figure 7F:
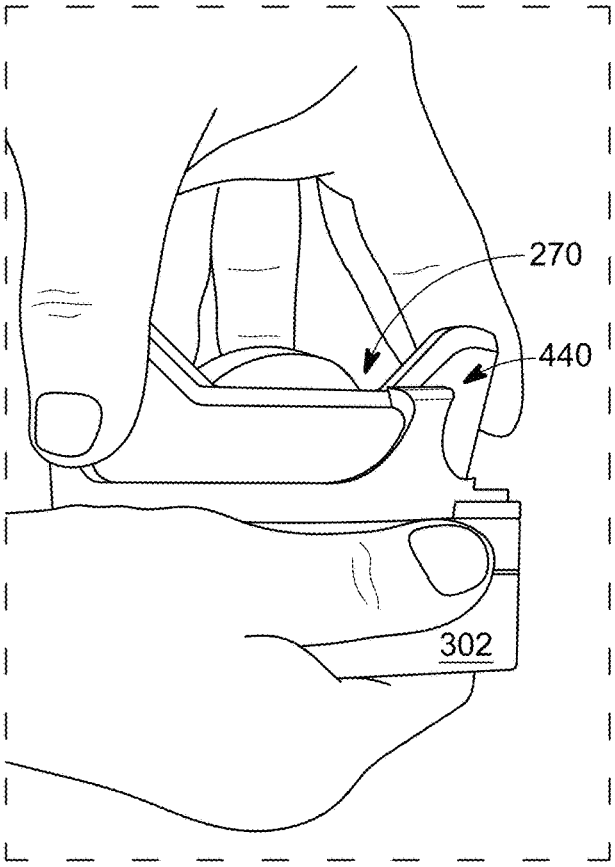
Figure 26:
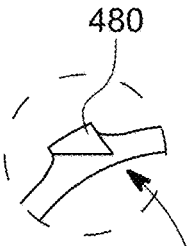
FIG. 26 depicts an underside view of a snap twist clip feature depicted in FIG. 24.
Figure 24:
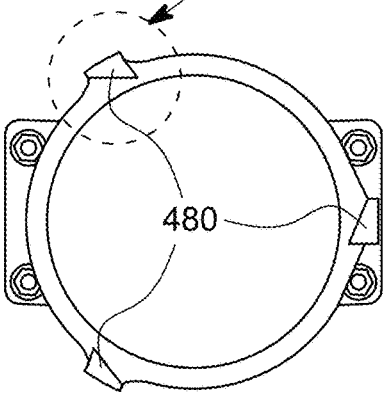
FIG. 24 is an underside view of the component from the plane 24-24 in FIG. 21.

FIGS. 7D, 7E, and 7F—which sequentially show how the enhanced agility-training device 300 of the present subject matter, now securely snap-engaged to the commercially available training device 230—can be separated from such other training device 230. First step: The housing 302 of the now snap-engaged unit—consisting of the enhanced agility-training device 300 and the other training device 230 secured thereto—is grasped with one hand (FIG. 7D) and inverted (second step: see FIG. 7E). Using the other hand to firmly grasp (third step: see FIG. 8A) each of the extending edge portions 284, 286, and 288 of the skirt-like structure 270, while rotating housing 302 relative to the skirt-like structure 270 fourth step, causes the feet 440 to slide along (fifth step) the skirt-like structure (FIG. 7E). A beveled feature for a snap, twist, or clip 480 (FIGS. 24, 26) of each foot 440 enables further rotation of one hand relative to the other hand (sixth step), while firmly grasping the housing 302 and the skirt-like structure 270 (seventh step), enables the housing 302 to be released (eighth step) from the skirt-like structure 270 (FIG. 7F).

Figure 13:
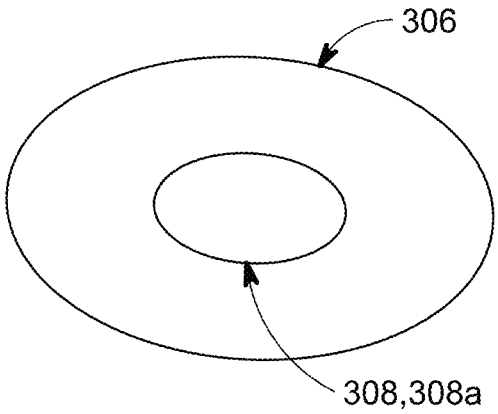
FIG. 13 depicts a solenoid feature, shown on an enlarged scale relative to FIG. 10.
Figure 15:
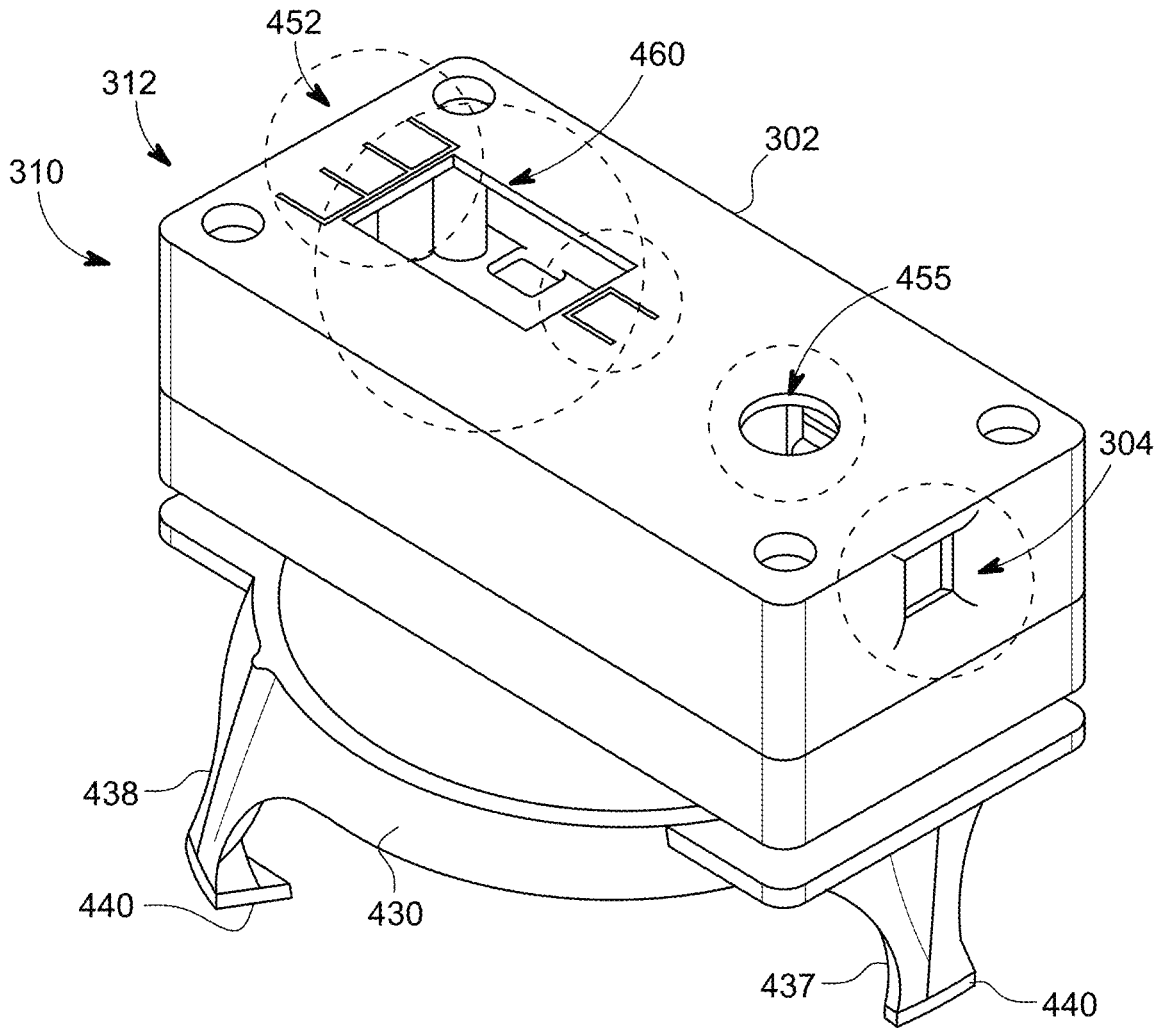
FIG. 15 is an upper perspective view of the joined system components of FIG. 10.
Figure 16:
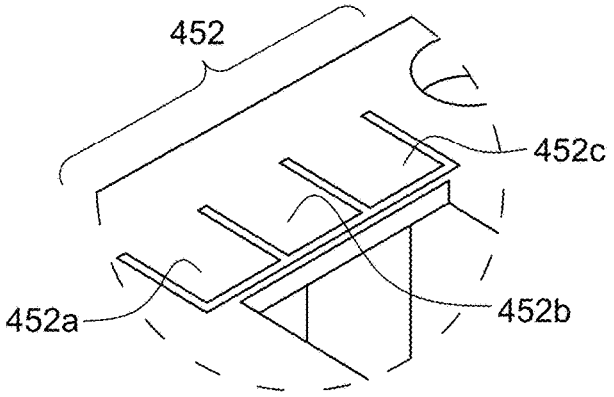
FIG. 16 depicts a mode-selection feature on an enlarged scale relative to FIG. 15.
Figure 17:
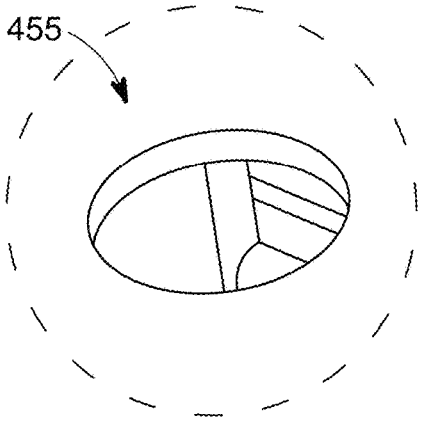
FIG. 17 is a buzzer feature that is shown on an enlarged scale relative to FIG. 15.
Figure 18:
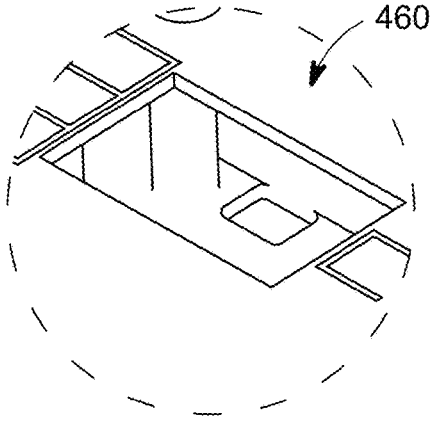
FIG. 18 depicts a display feature, shown on an enlarged scale relative to FIG. 15.
Figure 19:
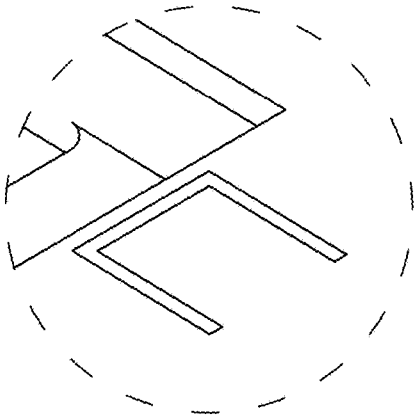
FIG. 19 presents a reset feature, shown on an enlarged scale relative to FIG. 15.
Figure 20:
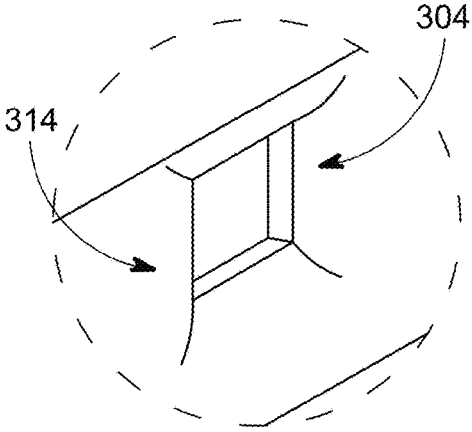
FIG. 20 shows a distance-sensor feature, on an enlarged scale relative to FIG. 15.
Figure 21:
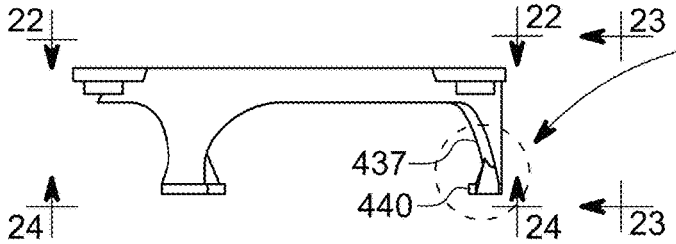
FIG. 21 is a side elevational view of an embodiment of a component of the system.
Figure 25:
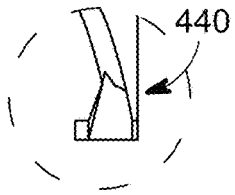
FIG. 25 is a side elevational view of a snap twist clip feature presented in FIG. 21.

Additional features of the agility-training athlete-interactive system 110 of the present subject matter comprise the frame 200 (FIGS. 4A, 5), the mounting plates 210 (FIG. 6) or 210*a* (FIG. 27) removably secured to the frame 200, and at least one athlete agility-training device 230 (FIGS. 4A, 5) removably secured to an associated mounting plate (210, 210*a*). Additional features of the agility-training athlete-interactive system 110 of the present subject matter include the enhanced athlete-interactive agility-training device 300 (shown in FIGS. 7 and 8) which includes housing 302 (FIGS. 9, 10, and 15) which has plural apertures. One such aperture has reference numeral 304 (FIGS. 10, 20) and another such aperture has reference numeral 306 (FIGS. 10, 13). Embodiments of the enhanced agility-training device 300 include an impact-generating mechanism 308 (FIG. 13), e.g., a solenoid, disposed within housing 302 (FIG. 10). The impact-generating mechanism 308 (e.g., the solenoid) includes a tapper member 308*a* (FIG. 13), extendable and retractable in a reciprocating manner through one aperture 306 (FIGS. 10, 13) of the two apertures 304 (FIGS. 15, 20) and 306 (FIGS. 10, 13) of the housing 302. The enhanced athlete-interactive agility-training device 300 also includes a control unit 310 (FIGS. 10, 15) disposed in the housing 302 of the enhanced agility-training device 300.

Within housing 302 (FIG. 10), control unit 310 is operably connected to the impact-generating mechanism 308 (FIG. 13) for causing the tapper mechanism 308*a* to move in a reciprocating manner and controllably extend outwardly from the aperture 306 and retract back into the housing 302. Enhanced athlete-interactive agility-training device 300 also includes a microprocessor 312 (FIGS. 10, 15) with memory for storing data (received, e.g., from a motion sensor or an accelerometer) disposed in housing 302, and operatively connected to control unit 310. The enhanced athlete-interactive agility-training device 300 includes a motion and/or distance sensor 314 (FIG. 20) disposed in the housing 302 adjacent to the other aperture 304 (FIGS. 15, 20) of the two apertures (304, 306) noted. A sensor 314 (FIG. 20), operably connected to control unit 310, is adapted and configured to project a motion-detecting and/or a distance-detecting beam through the aperture 304.

In accordance with the present subject matter, at least one athlete reaction-training device 230 (FIGS. 4A, 5, 7, 8) is removably secured to a sole enhanced athlete-interactive agility-training device 300 such that reciprocating motion of an end portion of the tapper member 308*a* (FIG. 13), from an initially retracted position, spaced closely adjacent to an inner surface of the housing 302 (see FIG. 7A) in relation to a further extended position (spaced a predetermined distance from an exterior surface, or surface portion, of housing 302 (see, for example, FIGS. 7A, 9, 10, and 13), is caused by operation of the motion and/or distance sensor 314 (FIG. 20), disposed in housing 302, when a motion-detecting and/or a distance-detecting beam detects movement or placement of a person or a thing either toward, transverse to, or adjacent to the motion and/or distance sensor 314. In addition, when the enhanced interactive agility-training devices 300 is in "Homebase 2" mode (described below), detection of the movement or placement of a person or a thing—leaving the detection area after having been in the detection beam—is included. At such times, tapper member 308*a* "taps" the impact-sensitive surface 234, which causes the light-emitting device 232 to cease light-flashing emission. At least one of the plural mounting plates 210 (FIG. 6), 210*a* (FIG. 27) is removably secured to frame 200 adjacent to knee 256 (FIG. 5). At least another one of the plural mounting plates 210 is removably secured to frame 200 adjacent to the second end portion 248 of the at least one arm 244.

Figure 31:
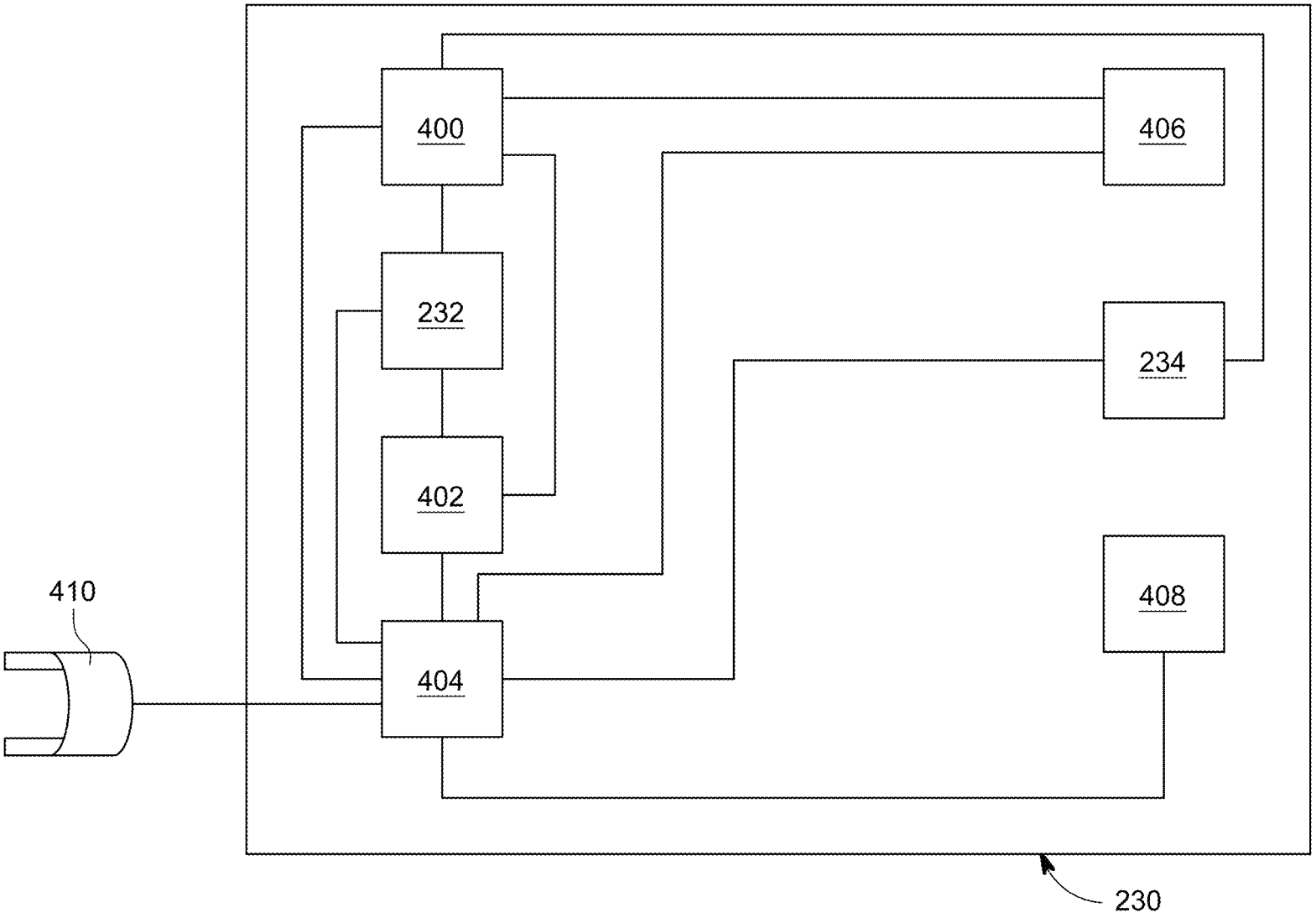
FIG. 31 is a schematic presenting various components of an agility-training device.

Each of the plurality of athlete agility-training (or reaction-improving) devices 230 (see, e.g., FIGS. 4A, 5) includes a controller 400 for the agility-training device 230, a timing circuit 402 for the agility-training device 230, as well as a power source 404 for the agility-training device 230. (Please see FIG. 31.) The controller 400, operatively connected to at least one microprocessor 406 for the agility-training device 230, is also operatively connected to one of the light-emitting devices 232 (see, e.g., FIGS. 5, 31) as well as one of the impact-sensitive surfaces 234 (described above) for the agility-training device 230. (See, e.g., FIGS. 7, 31.) In addition, the timing circuit 402 is operatively connected to the controller 400 for the agility-training device 230. The timing circuit 402 causes the light-emitting device 232 to emit light flashes for preselected lengths of time. The power source 404 is operatively connected to controller 400, the microprocessor 406, the timing circuit 402, the light-emitting device 232, and the impact-sensitive surface 234. The power source 404 is operatively associated either with at least one battery 408 or a connection 410 to a power provider, e.g., an electricity generator or a public utility facility.

The enhanced agility-training device 300 of the present subject matter comprises one of the athlete agility-training or reaction-improving devices 230 (described above) as well as an associated one of the housings 302 (described above). See, also FIGS. 7, 8. The enhanced athlete-interactive agility-training device 300 includes a two-position on/off switch 420 (see FIGS. 10, 14) having an "on" position and an "off" position. Switch 420 is mounted on housing 302. The impact-generating mechanism 308 (FIG. 13) and the motion and/or distance sensor 314 (FIG. 20) are operatively connected, adapted, and configured to be powered when switch 420 is positioned in the "on" position. Otherwise, power provided to the impact-generating mechanism 308 as well as to the motion and/or distance sensor 314 ceases when the on/off switch 420 is switched to its "off" position.

The enhanced agility-training device 300 (FIGS. 7, 8) includes a foundation, base, or pedestal 430 (FIGS. 7-10, 15) removably secured by threaded fasteners 435 (FIG. 10) to the housing 302. In addition, the foundation, base, or pedestal 430 includes two or more (for example, three or four) spaced-apart integral legs (e.g., elongated members) extending therefrom. Two such integral spaced-apart members 437, 438 (FIG. 15) of three such spaced-apart members 437, 438 and 439 (FIG. 10) extend from the base 430. Each such leg (437, 438, and 439) includes an end portion (referred to as a "foot") 440 (please see FIGS. 10 and 15) that is designed, dimensioned, adapted, and configured to removably secure the foundation (or base) 430 to an associated mounting plate 210, 210*a* (FIGS. 6, 9, 27). Each such mounting plate 210, 210*a* is individually removably secured to the frame 200 (FIG. 5). The foundation (or base) 430 (FIGS. 7-10, 15) is removably secured by a plurality of threaded fasteners 435 (FIG. 10) to an underside of housing 302.

The mounting plate 210 (FIG. 6), 210*a* (FIG. 27) is planar and defines at least three apertures 222, 224, 226 through plate 210, 210*a*. One aperture 222 (of the three apertures 222, 224, 226) is centrally located on the plate. Each of the other two apertures 224, 226 provides plate 210 with a pair of spaced-apart interior sidewalls (e.g., sidewalls 224*a* and 224*b*) for aperture 224 and (e.g., sidewalls 226*a* and 226*b*) for aperture 226. Each sidewall 224*a* (of each spaced-apart pair of sidewalls 224*a*, 224*b*) of each mounting plate 210 is radially spaced from a center point (C.P.) of its central aperture 222 (FIG. 6) while the other sidewall 224*b* (of each of the spaced-apart pair of sidewalls 224*a*, 224*b*) is helically spaced from the center point (C.P.) of its mounting plate central aperture 222.

The base or foundation 430 (FIGS. 10, 15) and each attached mounting plate 210, 210*a* is adapted, configured, and dimensioned relative to each other such that each of the two or more integral members or legs 437, 438, and 439 (FIG. 10) extending from the base or foundation 430 are insertable into and retractable from the other two apertures (i.e., apertures 224, 226) of the at least three apertures (e.g., 222, 224, and 226). See FIG. 6. In addition, the end portions or feet 440 (FIG. 10) of each of the at least three legs or members 437, 438, and 439 are sized, adapted, and configured, relative to associated ones of the at least three apertures (e.g., 222, 224, and 226) such that rotation of the base or foundation 430 relative to the mounting plate 210 about an axis X-X (FIG. 9) disposed transverse to the mounting plate 210 and through the central aperture 222 of the mounting plate 210 (FIG. 6) either causes the base or foundation 430 and mounting plate 210 to be removably secured together or releasable from each other when two or more legs or members (e.g., 437, 438, and 439) are inserted into the at least two apertures (e.g., 222, 224, and 226) of the plate 210. In embodiments of the present subject matter, the base or foundation 430 component may have a ring-like appearance. Thus, a preferred embodiment is where the three legs 437, 438, and 439 (FIG. 23) of the foundation, base, or pedestal 430 (FIG. 10) are inserted into respective ones of the three apertures 224, 226, and 228 of the mounting plate 210 (FIG. 6), and then twisted relative to the mounting plate 210 plate, to tightly secure the foundation or base 430 to plate 210.

Figure 8:
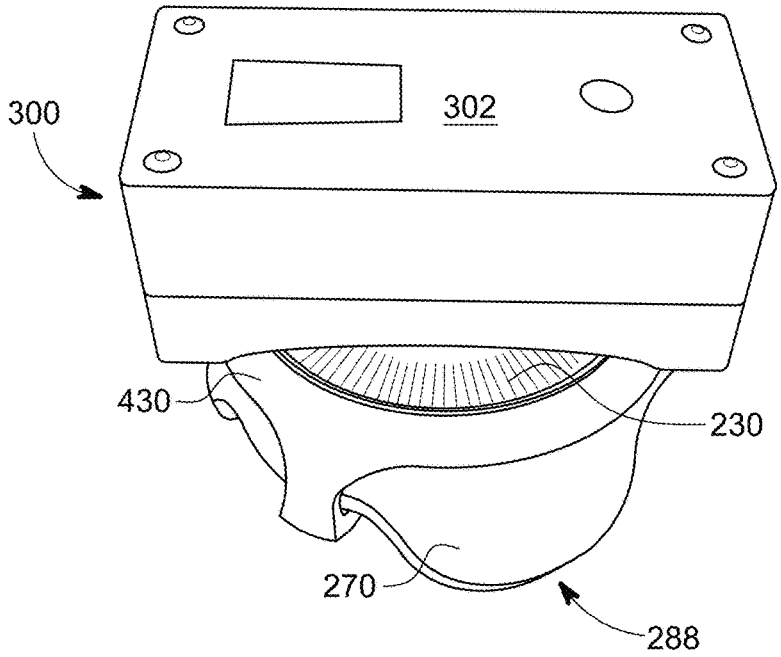
FIG. 8, a side elevational view, shows system components (of FIG. 7) assembled.

For an embodiment (e.g., FIG. 8A) described above, the foot 440 (FIG. 10) of each leg 437, 438, and 439 of the base 430 (FIGS. 7-10) is sized, adapted, and configured to be removably secured to peripheral edge margins of the skirt-like structure 270 (FIG. 7), which removably secures base 430 to its athlete reaction-training device 230 (FIG. 8).

Reference is next invited to review FIGS. 10 through 20, which provide a detailed description of additional features of the enhanced athlete-interactive agility-training device 300 (see, e.g., FIGS. 7, 8) of the present subject matter. The agility-training device 300 includes a light sensor 450 (FIGS. 10, 11), which is used by the agility-training device 300 to detect when the athlete reaction-training device 230 (FIG. 7) is lit. The enhanced interactive agility-training device 300, of the present subject matter, also includes a feature-selection panel 452 (FIGS. 15, 16) which includes a first button 452*a* that is used to control sensitivity to light, a second button 452*b* that is used to control an on/off function of a buzzer, "activated" (i.e., caused to buzz) when light from the device 230 is detected, and a third button 452*c*, to activate a delay-to-rearm feature of agility-training device 300.

By choosing and activating select features of the enhanced athlete-interactive agility-training device 300 of the present subject matter, a user can "set" the agility-training device 300 either in a primary (or "homebase") mode or in an auxiliary (or "target") mode.

For instance, a portal 455 (FIGS. 15, 16) on housing 302 is adapted, configured, and dimensioned for enabling sound (from, e.g., a buzzer, speaker, etc.) to be output from agility-training device 300 when selected features cause device 300 to be in target mode.

In addition, located on housing 302 is a display panel 460 (FIGS. 15, 18) designed, sized, adapted, and configured to show several additional features including but not limited to a baseline feature for a "light reading" instrument, an electrical current-usage detector for a "light reading," a distance detector, a battery %-charge gauge, and so forth.

Figure 32A:
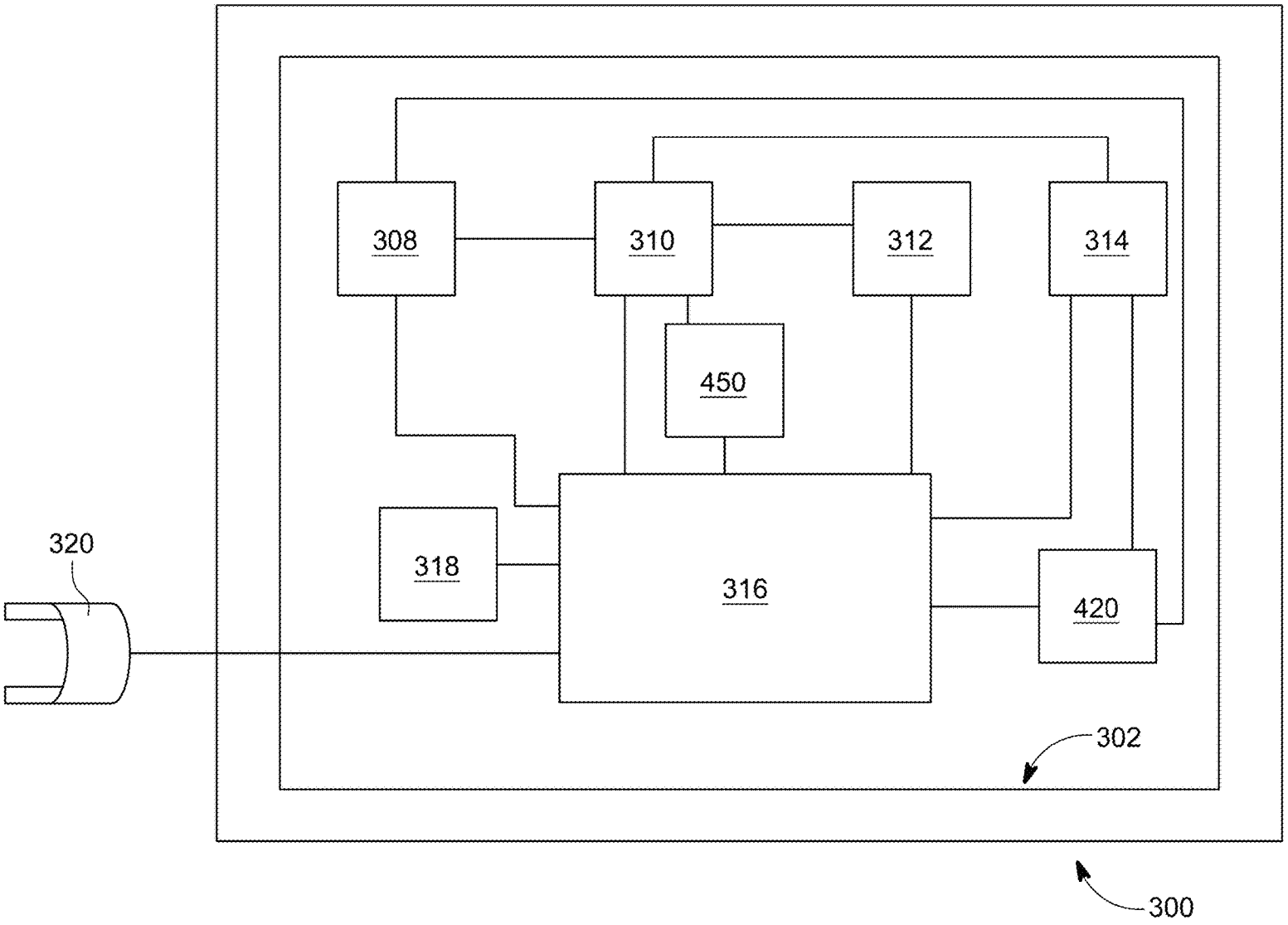
FIG. 32A is a schematic, depicting components of a primary agility-training device.
Figure 32B:
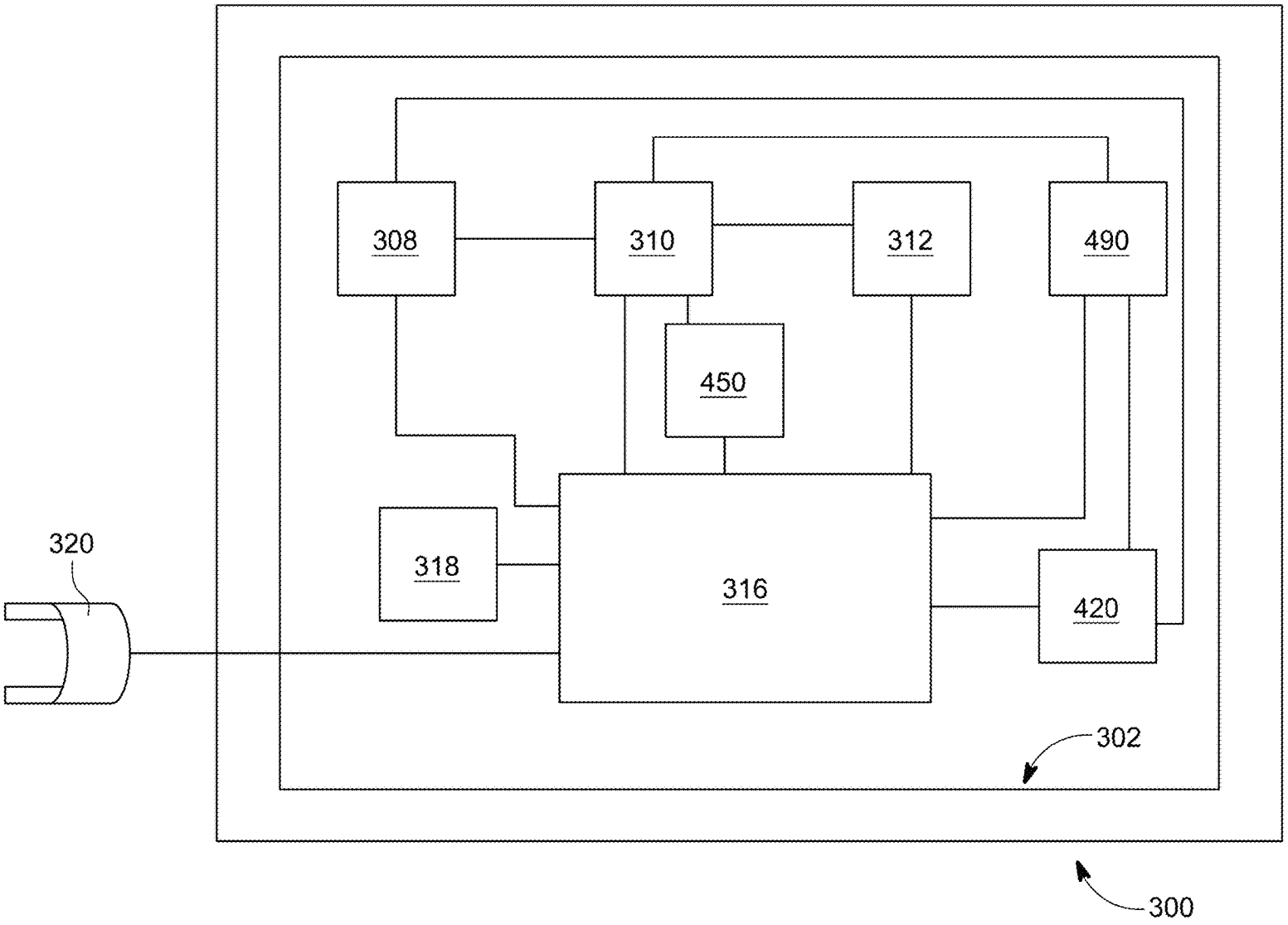
FIG. 32B is a schematic of components of another primary agility-training device.

The "reset" feature (shown in FIGS. 15 and 19), when "hit," resets software, on which a microprocessor 312 and a control unit 310 (both described below; see FIG. 32A), are running. "Hitting" the reset feature initializes a display panel 460 (described below; see FIGS. 15, 18) and takes a default light sensor reading (which should be taken when the light-emitting device 232 is turned "off"). This reading becomes a baseline, which accounts for ambient light level in a room, enabling an accurate, reliable, and reproducible reading to be made to determine that the reaction training device 230 has lit up. From reset "mode," controller 400 returns reaction-training device 230 (FIG. 7) to "Homebase" mode. A "charge port" 475 feature (shown in FIGS. 10 and 12) is a USB-C port used for software updates (for the microprocessor 312 and a controller 400) and for recharging battery 318 described below (FIG. 32A). A person of ordinary skill in the art ("POSITA") would know that a USB-C or that a USB Type-C connector is a common 24-pin connector (not a "protocol" type) that supersedes previous USB connectors and that carries audio, video, and other data, e.g., to drive multiple displays or to store a backup to an external drive. It may be used to provide power, e.g., to laptops, mobile phones, or other devices.

Please refer to FIGS. 29, 30 for an illustration of an enhanced athlete-interactive agility-training system 500 which includes, e.g., one of the enhanced athlete-interactive agility-training devices 300 in primary (i.e., "homebase") mode as well as one of the enhanced athlete-interactive agility-training devices 300 in auxiliary (i.e., "target") mode. While "homebase" mode generally "triggers" on object detection in a beam, "target" mode, in addition to this description, adds an audible alert to light detection and will be "triggered" by on object detected in its beam. Additional modes include: "homebase2" mode, which "triggers" on object removal from a beam, producing sound (e.g., a beep) every 3 seconds to let an athlete know when he/she is in a "proper" predetermined position. "Beat" mode uses an accelerometer to detect when a training device is sharply jostled. In addition, "press" mode uses the accelerometer to detect when a training device is gently moved.

The enhanced agility-training device 300 (see, e.g., FIGS. 7 and 8) of the present subject matter also includes a feature selection panel 452. (See, e.g., FIGS. 15 and 16.) In operation, "hitting" second button 452*b* controls an on/off function of a buzzer that is "activated" (i.e., caused to buzz) when light from device 230 is detected. "Hitting" second button 452*b* also causes cycling through the five modes described; and, depending upon the mode selected, causes the first button 452*a* (usually "hit" to control sensitivity to light) and the third button 452*c* (usually "hit" to activate a delay-to-rearm feature of training device 300) to control several functions (including but not limited to light sensitivity control, volume control, and trigger-delay control) which may be different from original functions.

FIG. 29 depicts a student 502 engaged in a lunging motion, when prompted by the enhanced athlete-interactive agility-training system 500 of the present subject matter. Mounted on frame 200 are three agility-training devices 230. Other embodiments of an athlete-interactive system 120 of the present subject matter (FIG. 4) include a system comprising the enhanced agility-training device 300 set to an auxiliary, i.e., "target" mode and mounted on a tripod 510. For the example shown in FIGS. 29 and 30, one of a pair of enhanced interactive agility-training devices 300 of the present subject matter is set to function in a primary, i.e., homebase mode, while the other one of a pair of enhanced agility-training devices 300 of the present subject matter is set to function in its auxiliary (or so-called target mode. FIG. 30 also shows the fourth student 502 (please see also FIG. 29) in a retreating motion, to reach an agility-training device 300 in the foreground, which is lit and emitting a buzzing sound, when in its target mode. For the example shown in FIG. 4, the athlete-interactive system 120 is set to its Homebase or Homebase2 mode.

Figure 30A:
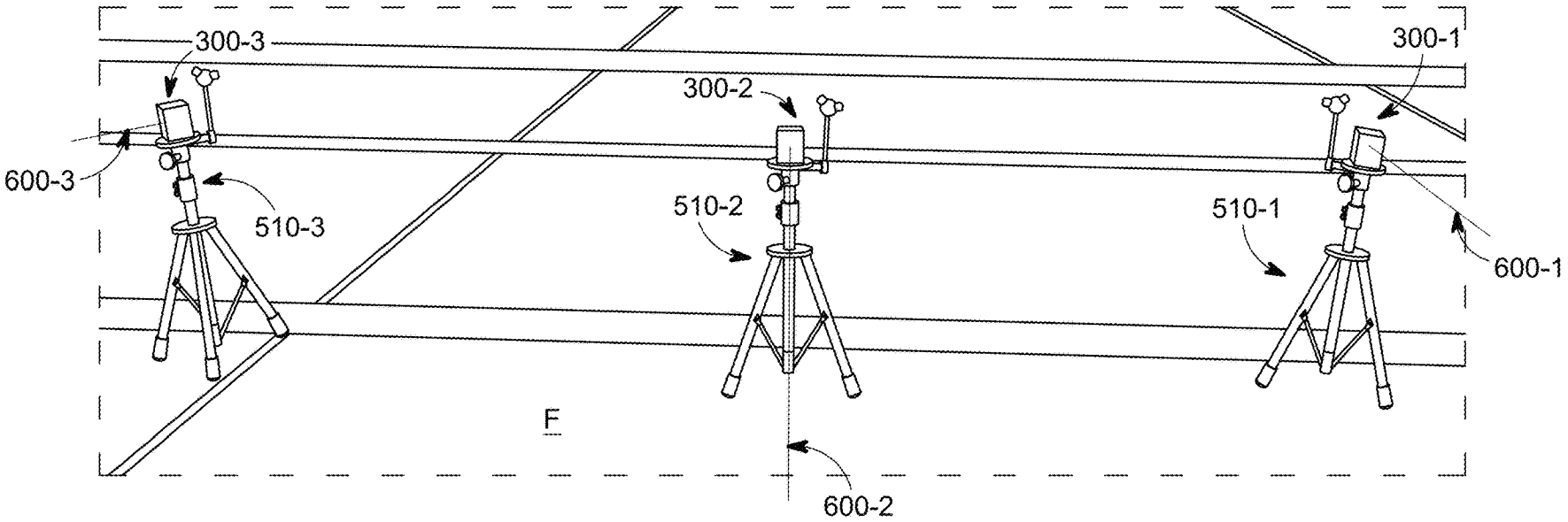
FIGS. 30A, 30B, 30C, and 30D depict a plurality of operably connected interactive systems of the present subject matter functioning collaboratively in a "stand alone" mode.
Figure 30B:
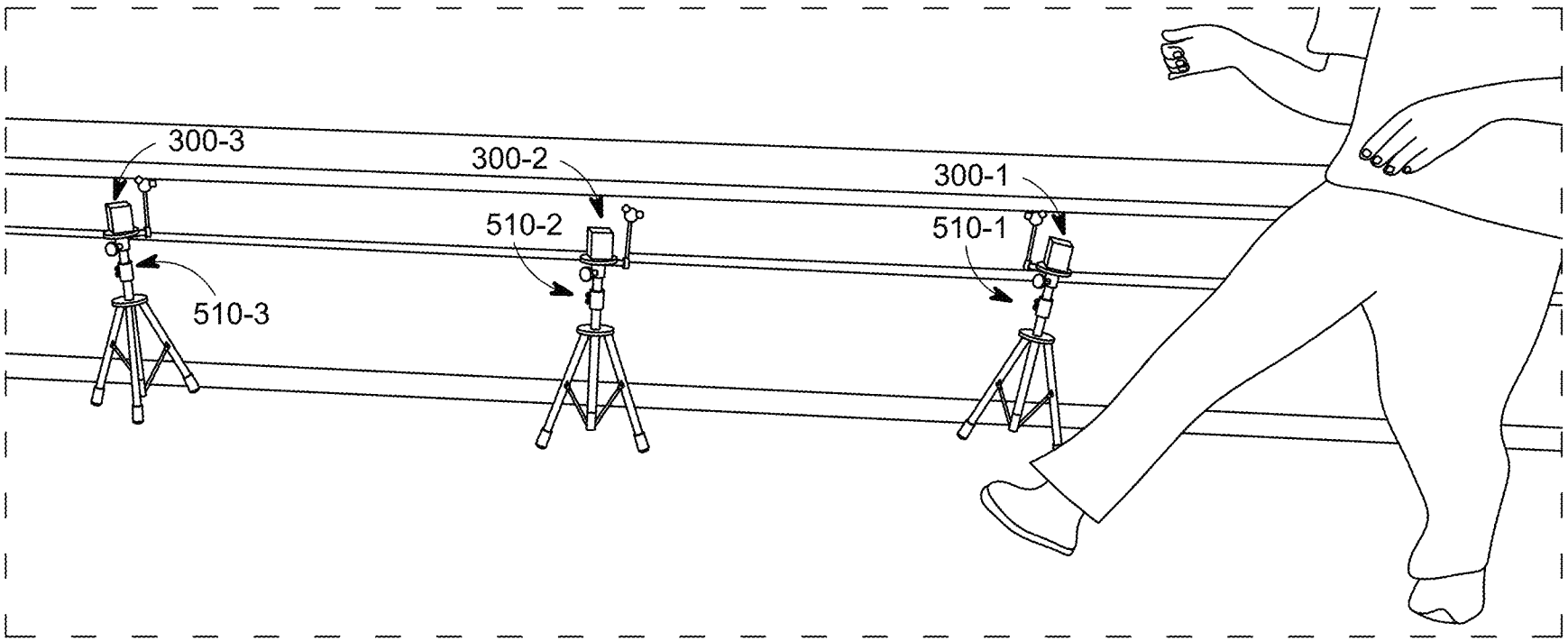
Figure 30C:
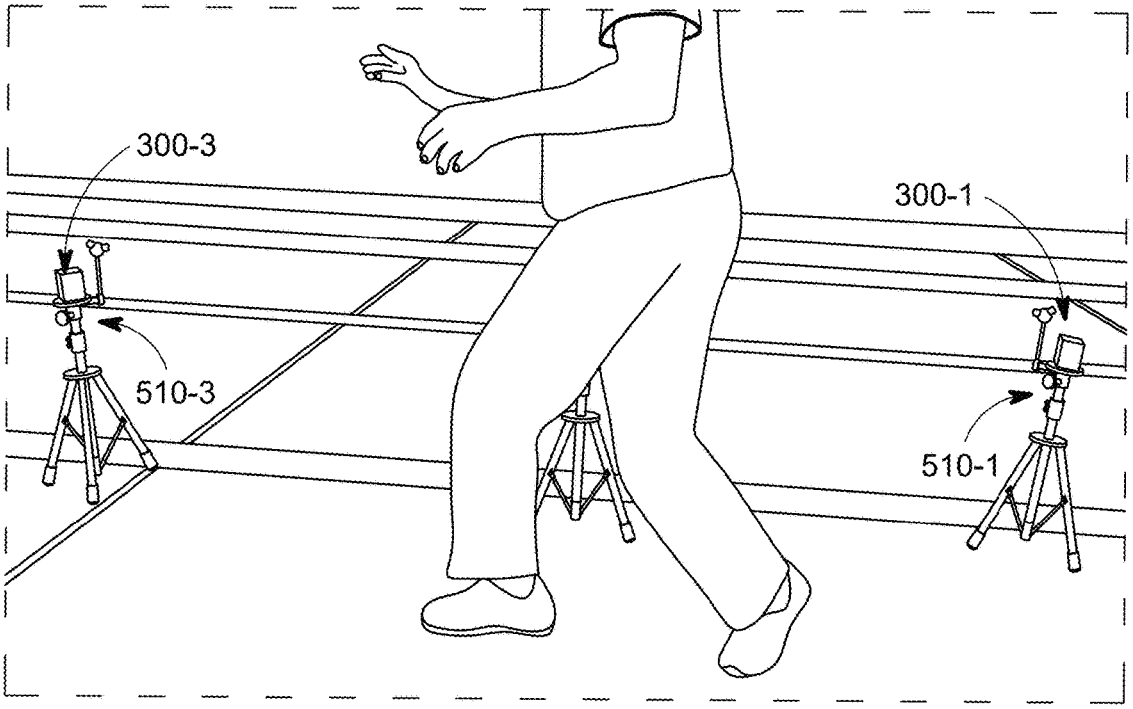
Figure 30D:
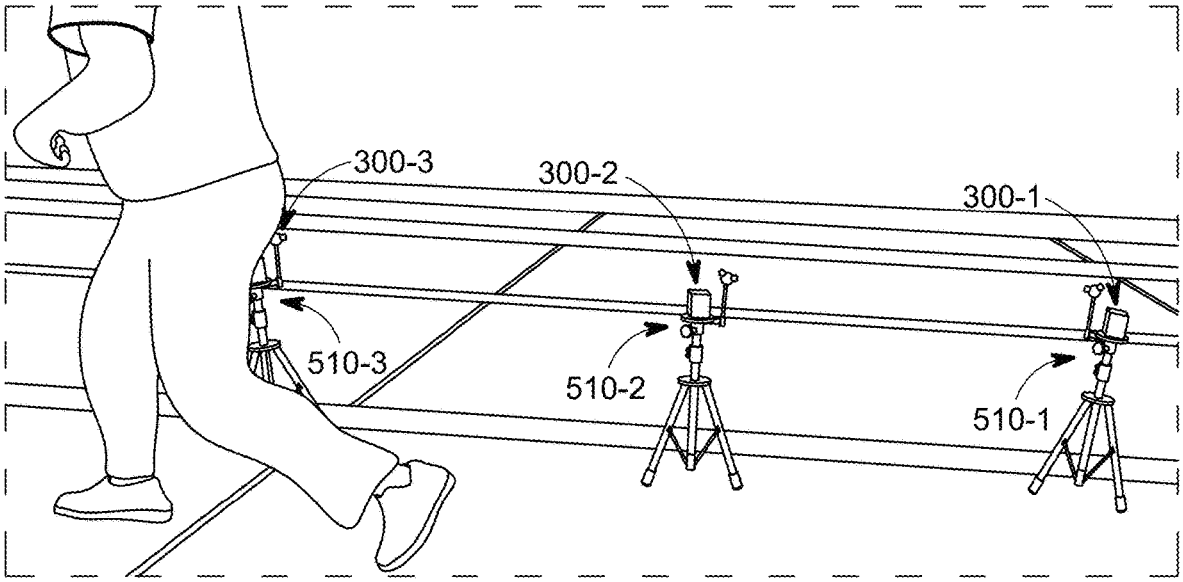

FIGS. 30A, 30B, 30C, and 30D depict a plurality of operably connected interactive systems of the present subject matter functioning collaboratively in a "stand alone" mode. For instance, FIG. 30A shows three wirelessly operatively coupled agility-training devices 300-1, 300-2, and 300-3, respectively mounted atop the tripods 510-1, 510-2, and 510-3. Distances between the tripods 510-1, 510-2, and 510-3 are known. The agility-training devices 300-1, 300-2, and 300-3 collectively are respectively emitting motion-detection beams 600-1, 600-2, and 600-3 parallel to a predetermined distance above the floor ("F").

Figure 33A:
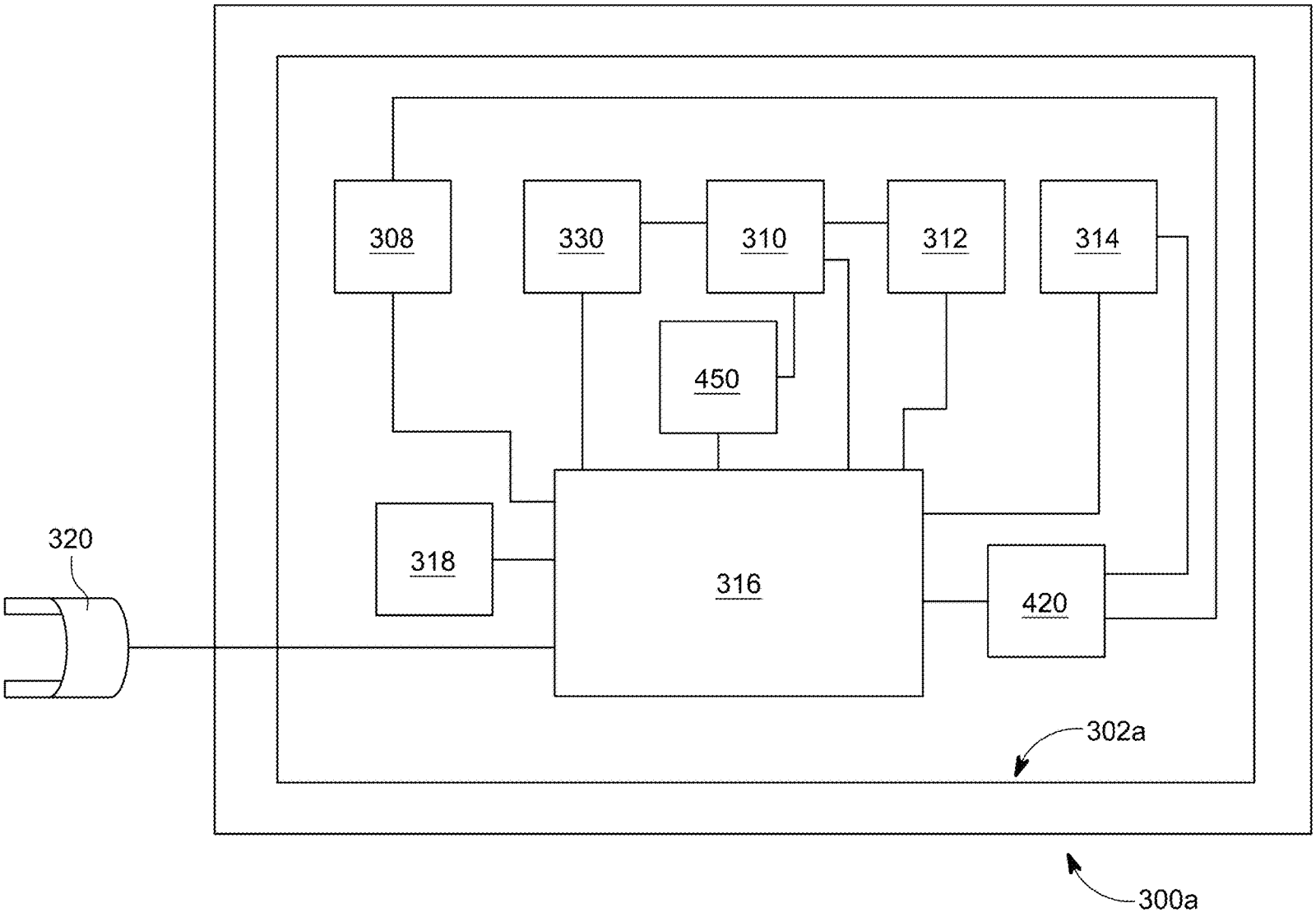
FIG. 33A is a schematic showing components of an auxiliary agility-training device.

The motion-detection beams 600-1, 600-2, and 600-3, when broken by a person moving across the floor and through the beams 600-1, 600-2, and 600-3, trigger a motion and/or distance sensor 314 (FIGS. 32A, 33A) to record in memory of the microprocessor such information or data as start time (on clock) including amount of time for each beam interrupting event. Footwork between timed beams is, accordingly, timed and recorded.

Each stand-alone tripod 510-1, 510-2, 510-3 can have its respective beam 600-1, 600-2, 600-3 triggered when a person enters or leaves the beam 600-1, 600-2, or 600-3.

Figure 22:
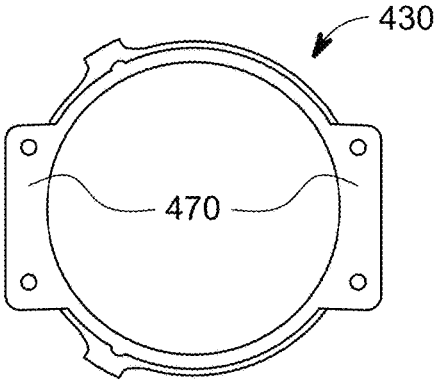
FIG. 22 presents a plan view of the component from the plane 22-22 in FIG. 21.
Figure 23:
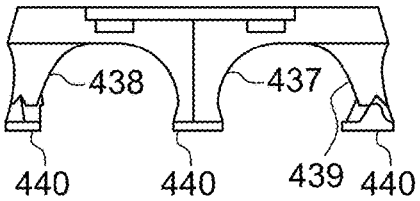
FIG. 23 depicts a side elevational view taken from plane 23-23 shown in FIG. 21.

Reference is next directed to FIGS. 21 through 26 for a detailed description of additional features of the enhanced athlete-interactive agility-training device 300 of the present subject matter. The foundation, base, or pedestal 430 of the enhanced athlete agility-training device 300 (FIG. 7) of the present subject matter may include two or more (for instance, three, four, or five) spaced-apart integral legs (e.g., elongated members) extending therefrom. As shown in FIGS. 10 and 23, three such spaced-apart elongated members or legs 437, 438, and 439 extend from the foundation, base, or pedestal 430. Each such elongated member or leg 437, 438, and 439 has an end portion or foot 440 (see FIGS. 21, 23, and 25) that is dimensioned, adapted, configured, and designed to removably secure the base 430 to an associated mounting plate 210, 210*a* (FIGS. 6, 9, and 27). A ring-like embodiment of the foundation, base, or pedestal 430 of the enhanced athlete agility-training device 300 shown in FIG. 22 includes an integral apertured platform 470 used to removably secure the housing 302 thereto by using the fastener means 435.

Figure 8A:
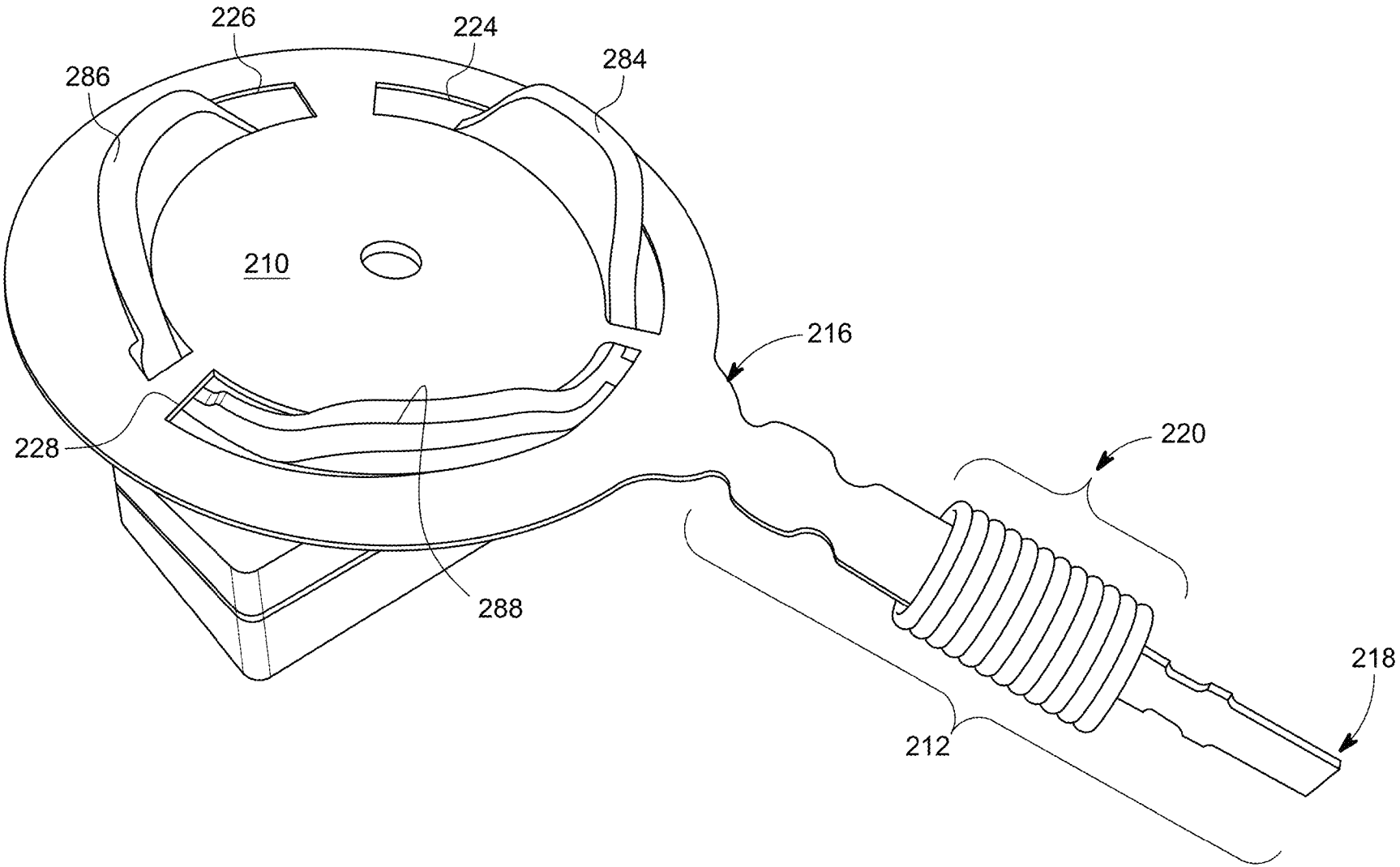
FIG. 8A presents a bottom view of an embodiment of the present subject matter.
Figure 9:
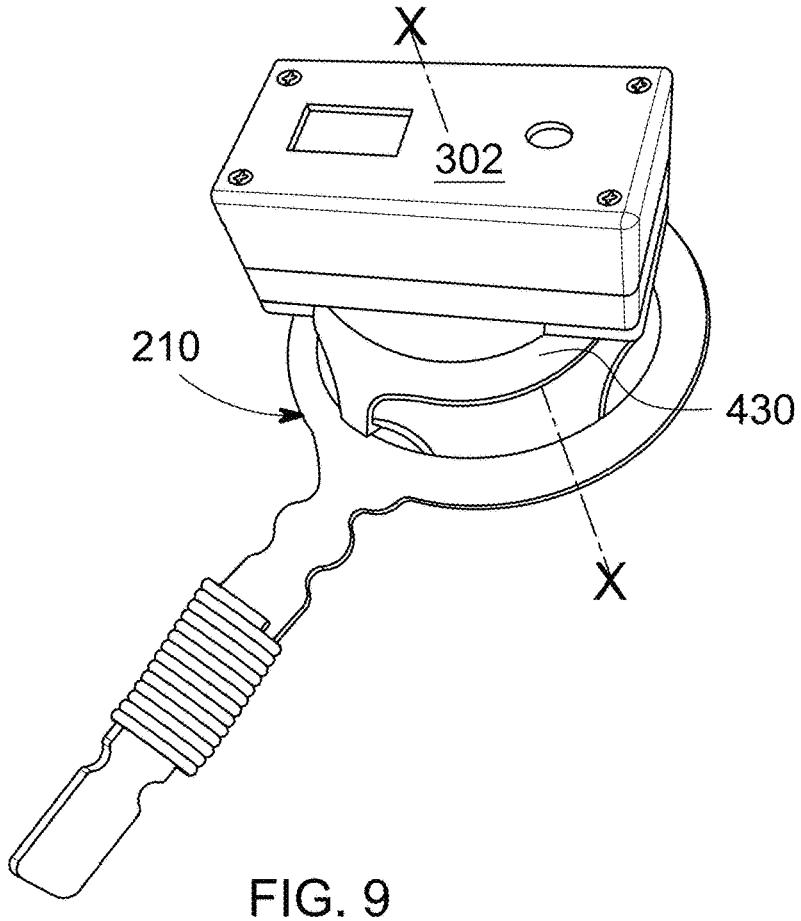
FIG. 9 is a perspective view, showing several system elements when assembled.

As described in detail above, for other embodiments of the present subject matter, the athlete agility-training device 230 (FIGS. 4A, 5) comprises a skirt-like structure 270 (FIG. 7) secured to the training device 230 along peripheral edge portions of the device 230. The skirt-like structure 270 (FIGS. 7, 8) includes peripherally equally spaced-apart extending edge portions 284, 286, and 288, each of which is sized, adapted, configured, and designed to be fitted into, and securely fixed to (but also removable from) respective apertures 224, 226, and 228 of the mounting plate 210 (FIG. 8A). In embodiments, the skirt-like structure 270 (see FIGS. 7 and 8) and the peripherally equally spaced-apart extending edge portions 284, 286, 288 (each unitary with the skirt-like structure 270) is manufactured from preselected materials—including rigid or flexible polymeric materials.

A snap, twist, or clip 480 feature (see FIGS. 24 and 26) unitary with an end portion of each leg or elongated member 437, 438, and 439 (FIG. 23) is sized, designed, adapted, and configured for not only securely "locking" each leg 437, 438, and 439 into, but also easily "unlocking" and thereby releasing each leg 437, 438, and 439 from, an associated one of the above-described helical-walled apertures 224, 226, and 228 of the mounting plate 210 (see, e.g., FIG. 6) or 210*a* (see, e.g., FIG. 27) for securing the legs 437, 438, and 439 of the foundation, base, or pedestal 430 of the enhanced athlete agility-training device 300 (see, e.g., FIG. 7) of the present subject matter to the skirt 270 of device 230.

The enhanced athlete-reaction and primary agility-training device 300 comprises: a housing 302 (FIGS. 7, 8) having at least two apertures 304 (FIG. 20) and 306 (FIG. 13).

The enhanced primary agility-training device 300 includes an impact-generating mechanism 308 (FIG. 13) disposed in housing 302. Impact-generating mechanism 308 includes a reciprocatingly movable tapper member 308*a*

(FIG. 13) having an end portion that is extendable from and retractable through aperture 306 of the at least two apertures.

The enhanced primary agility-training device 300 includes a control unit 310 disposed in housing 302. Control unit 310 is operably connected to the mechanism 308.

The enhanced primary agility-training device 300 also includes a microprocessor 312 that is disposed in the housing 302 and operably connected to the control unit 310.

The enhanced primary agility-training device 300 further includes a motion and/or distance sensor 314 disposed in housing 302 closely adjacent to (FIG. 20) aperture 304.

The motion and/or distance sensor 314, operably connected to control unit 310, is adapted and configured to project a motion-detecting beam through the aperture 304.

When motion by a person or a thing (vehicle, cat, dog, bird, insect, and so forth) is detected by the beam, the motion and/or distance sensor 314 causes impact-generating mechanism 308 to reciprocatingly move an end portion of tapper member 308*a* from an initial position adjacent to an inner surface of housing 302 to an extended position spaced a predetermined distance from an exterior surface of housing 302 when motion-detecting beam detects movement of a person or a thing toward or transverse to the sensor 314. In addition, "Homebase2" mode will detect motion by a person or thing leaving the beam.

The enhanced primary agility-training device 300 includes a two-position "on/off" switch 420 (FIG. 14) having an "on" position and an "off" position. The impact-generating mechanism 308 as well as the motion and/or distance sensor 314 are designed, adapted, and configured to receive power when switch 420 is positioned in the "on" position. Power provided to mechanism 308 and sensor 314 ceases when switch 420 is in its "off" position.

Figure 33B:
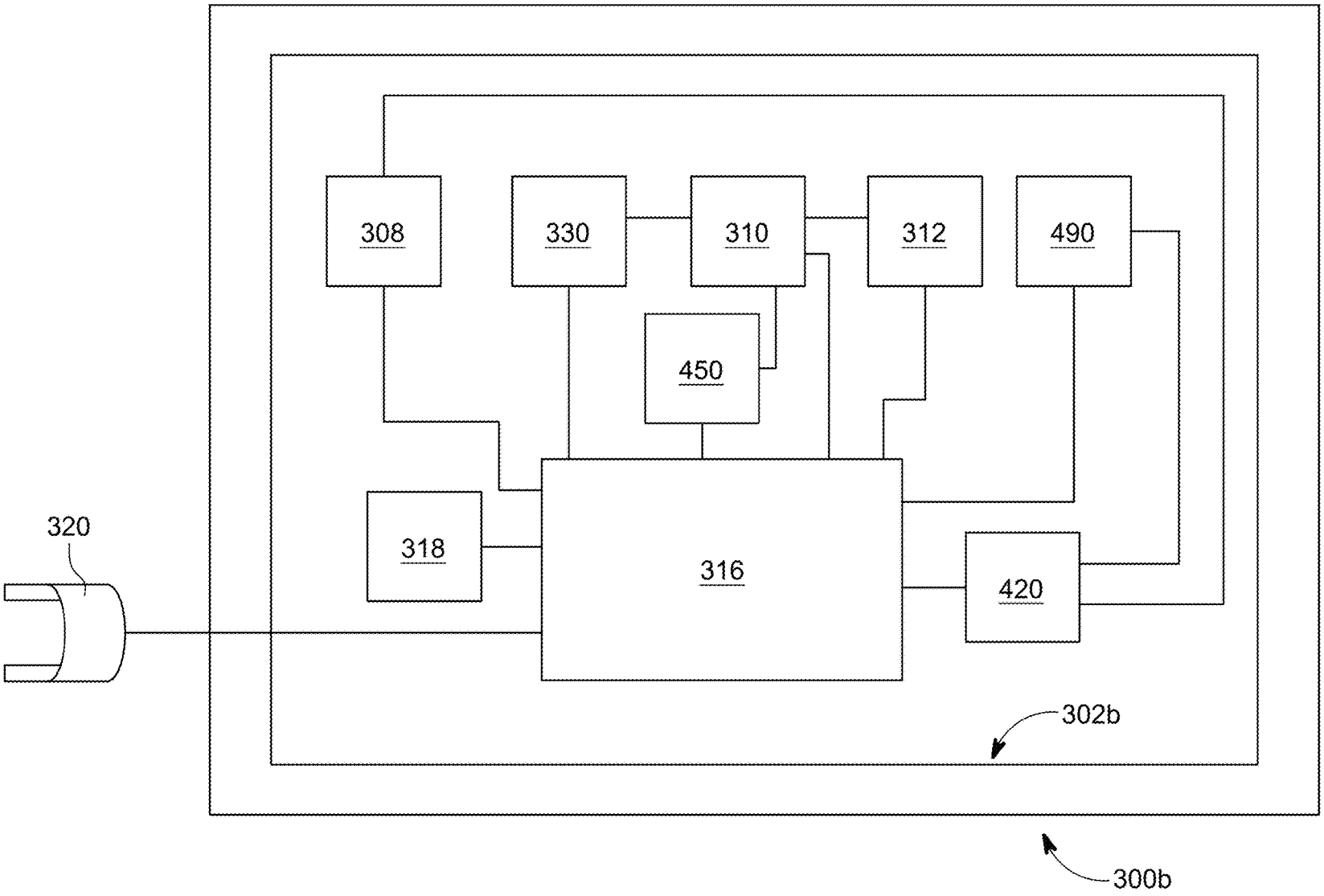
FIG. 33B is a schematic of components of another auxiliary agility-training device.

The enhanced primary agility-training device 300 of the present subject matter includes a conventional power source 316 (FIG. 32A) operatively connected to each of the following components of the primary agility-training device 300, including but are not limited to the following: a two-position switch 420, a light sensor 450, a motion and/or distance sensor 314, an impact-generating mechanism (i.e., an above-described solenoid) 308, a microprocessor 312, and a control unit 310. The power source 316 provides electrical power to each component. Light sensor 450, detecting device 230 is lit via its sensor, determines when to send a signal to solenoid mechanism 308. An embodiment of another enhanced primary agility-training device 300 illustrative of the present subject matter is presented in FIG. 33B where an embodiment of the motion and/or distance sensor 314 (described above in detail) is replaced by accelerometer 490.

In embodiments of the enhanced primary agility-training device 300, power source 316 may include at least one battery 318 (FIG. 32A) or an electrical connection 320 to an electrical power provider. The enhanced primary agility-training device 300 includes a foundation, base, or pedestal 430 (FIGS. 7-10, 15) secured to housing 302. Foundation, base, or pedestal 430 (FIGS. 7, 8, 22) includes integral spaced-apart legs (or elongated members) 437, 438, and 439 (FIGS. 10, 23) extending from the base 430 (FIGS. 10, 22).

Each leg or elongated member 437, 438, and 439 includes an end portion or foot 400 (FIGS. 10, 21, 23, and 25) designed, sized, adapted, and configured for removably securing the base 430 either to one mounting plate 210 (FIG. 6) or to another mounting plate 210*a* (FIG. 27), spaced from the housing 302 (FIG. 9), for an embodiment of the present subject matter, or for securing the base 430 to the athlete agility-training device 230, for yet another embodiment of the present subject matter (as shown in FIGS. 8, 8A).

An enhanced athlete-reaction and auxiliary agility-training device 300*a*: Moreover, as noted, the enhanced athlete-reaction and primary agility-training device 300 of the present subject matter, when switched from primary to auxiliary mode, can also function as an enhanced athlete-reaction and auxiliary agility-training device 300*a*, depending upon the agility-training features selected by a user. Accordingly, one such enhanced athlete-reaction and auxiliary agility-training device 300*a* (FIG. 33A) comprises a housing 302*a*, a light sensor 450 (FIG. 11) mounted in housing 302*a* (FIG. 10), and a control unit 310 disposed in the housing 302*a* and operably connected to the light sensor 450. The enhanced athlete-reaction and auxiliary agility-training device 300*a* also includes a microprocessor 312, disposed in the housing 302*a* and connected to the control unit 310.

The enhanced athlete-reaction and auxiliary agility-training device 300*a* includes a sound generator 330 (FIG. 33A) adapted and dimensioned to be disposed in housing 302*a* closely adjacent to the portal 455 (FIG. 17) and operably connected to the control unit 310. The auxiliary agility-training device 300*a* also includes a power source 316 operatively connected to each of the following components of the auxiliary agility-training device 300*a*. Such components include but are not limited to each of the following. The light sensor 450, the two-position switch 420, the motion and/or distance sensor 314, the impact-generating mechanism (i.e., the solenoid) 308, the microprocessor 312, and the control unit 310. The power source 316 provides electrical power to each component. The light sensor 450 is designed, adapted, and configured to send a signal to control unit 310 when light is sensed. Sound generator 330 is adapted and configured to generate a sound audible to a human whenever the light sensor 450 sends a signal to the control unit 310.

Figure 14:
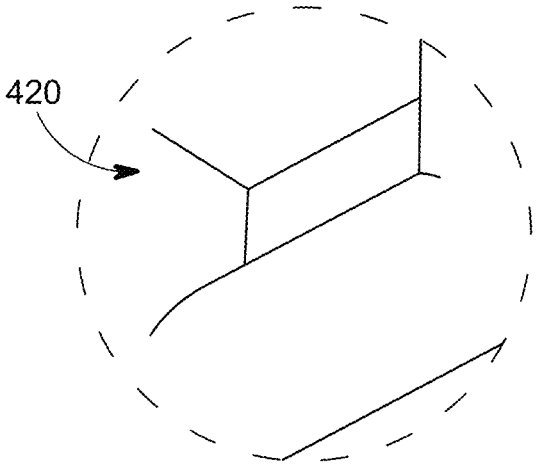
FIG. 14 presents an on/off-switch feature, on an enlarged scale relative to FIG. 10.

The enhanced athlete-reaction and auxiliary agility-training device 300*a* includes the two-position switch 420 (shown in FIGS. 10, 14). Switch 420 operates by using an "on" position (permitting electrical current to flow) and an "off" position (blocking current flow). While light sensor 450 and sound generator 330 are each adapted and configured to be provided power when switch 420 is positioned in the "on" position, power to the light sensor 450 and the sound generator 330 ceases when switch 420 is in the "off" position.

The enhanced auxiliary athlete-reaction and agility-training device 300*a* of the present subject matter further includes the power source 316, operatively connected to control unit 310, the microprocessor 312, the impact-generating mechanism (i.e., solenoid component) 308, light sensor 450, the sound generator 330, the motion and/or distance sensor 314, as well as the "on"/"off" (two-position) switch 420 to provide power to each.

For operational purposes, the power source 316 (of the enhanced athlete-reaction and auxiliary agility-training device 300*a* of the present subject matter) comprises at least one battery 318 or electrical connection 320 for the electrical power providing component.

Another enhanced athlete-reaction and auxiliary agility-training device 300*b*: An enhanced athlete-reaction and primary agility-training device 300 of the present subject matter, when switched from primary to auxiliary mode, may operate as a functionally different enhanced athlete-reaction and auxiliary agility-training device 300*b*, when an accelerometer 490 (FIG. 33B) is substituted for a motion and/or distance sensor 314 in the above-described athlete agility-training device 300 (FIG. 32A). Thus, an enhanced athlete-reaction and auxiliary agility-training device 300*b* (FIG. 33B) comprises a housing 302*b*, a light sensor 450 (FIG. 11) mounted in the housing 302*b* (FIG. 33B), and a control unit 310 disposed in the housing 302*b* and operably connected to the light sensor 450. The enhanced athlete-reaction and auxiliary agility-training device 300*b* also includes a microprocessor 312, disposed in the housing 302*b* and connected to the control unit 310.

The enhanced athlete-reaction and auxiliary agility-training device 300*b* includes a sound generator 330 (FIG. 33B) sized, adapted, and configured to be disposed in the housing 302*b* closely adjacent to the portal 455 (FIG. 17) and operably connected to the control unit 310. The auxiliary agility-training device 300*b* also includes a power source 316 operatively connected to each of the following components of the auxiliary agility-training device 300*b*. Such components include but are not limited to each of the following. The light sensor 450, the "on" and "off" two-position switch 420, the accelerator 490, the impact-generating mechanism (i.e., the solenoid) 308, the microprocessor 312, and the control unit 310. The power source 316 provides electrical power to each component. The light sensor 450 is designed, adapted, and configured to send a signal to control unit 310 when light is sensed. Sound generator 330 is adapted and configured to generate a sound audible to a human whenever the light sensor 450 sends a signal to the control unit 310.

The enhanced athlete-reaction and auxiliary agility-training device 300*b* includes the two-position switch 420 (shown in FIGS. 10, 14). Switch 420 operates by using an "on" position (permitting electrical current to flow) and an "off" position (blocking current flow). While light sensor 450 and sound generator 330 are each adapted and configured to be provided power when switch 420 is positioned in the "on" position, power to the light sensor 450 and the sound generator 330 ceases when switch 420 is in the "off" position.

The enhanced auxiliary agility-training device 300*b* of the present subject matter further includes the power source 316, operatively connected to the control unit 310, the microprocessor 312, the solenoid 308, light sensor 450, sound generator 330, accelerator 490 (FIG. 33B), and the "on"& "off" (two-position) switch 420 to provide power to each.

For operational purposes, the power source 316 (of the enhanced athlete-reaction and auxiliary agility-training device 300*b* of the present subject matter) comprises at least one battery 318 or electrical connection 320 for the electrical power providing component.

Figure 34A:
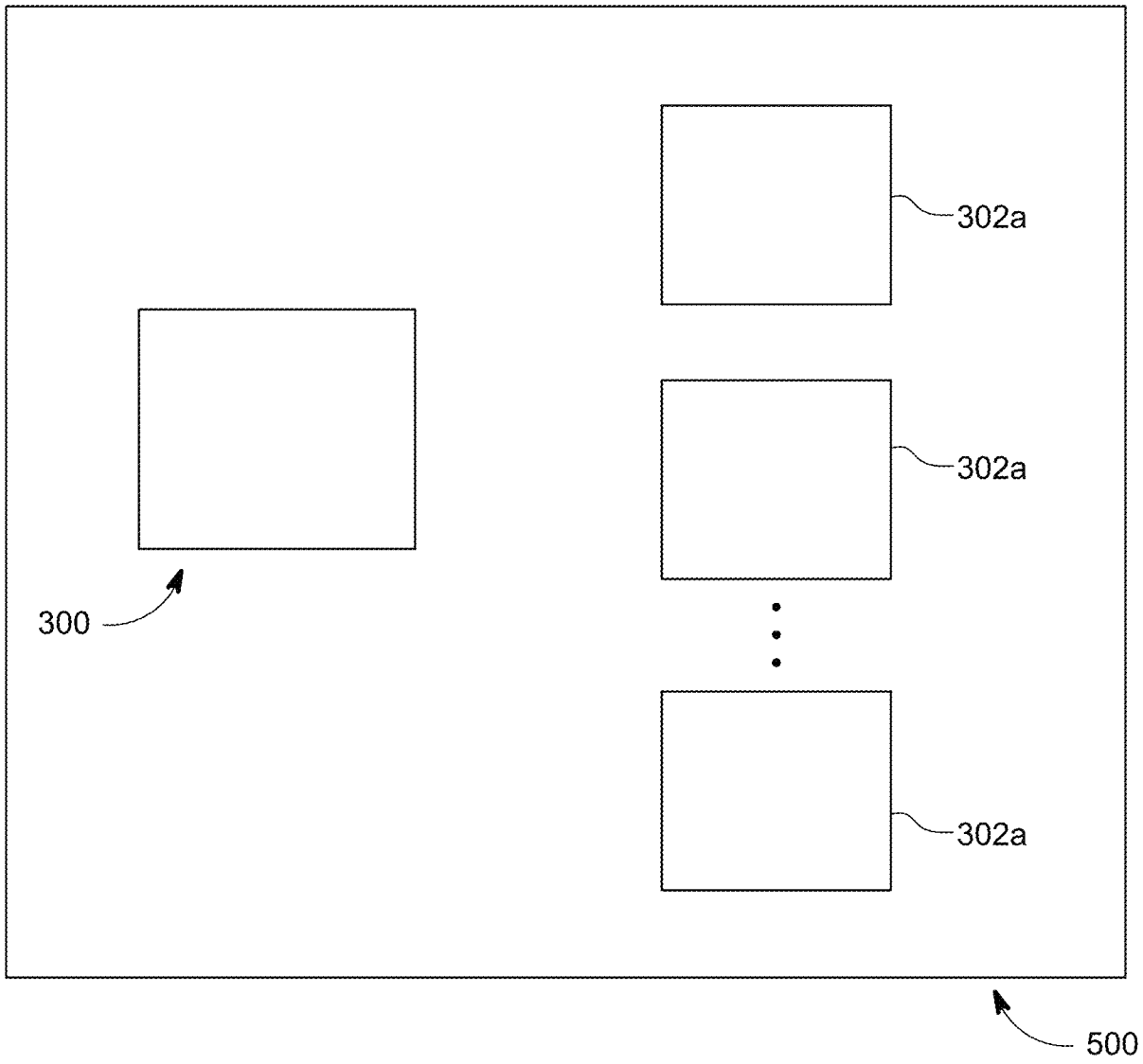
FIGS. 34A, 34B are systems showing primary and auxiliary agility-training devices.
Figure 34B:
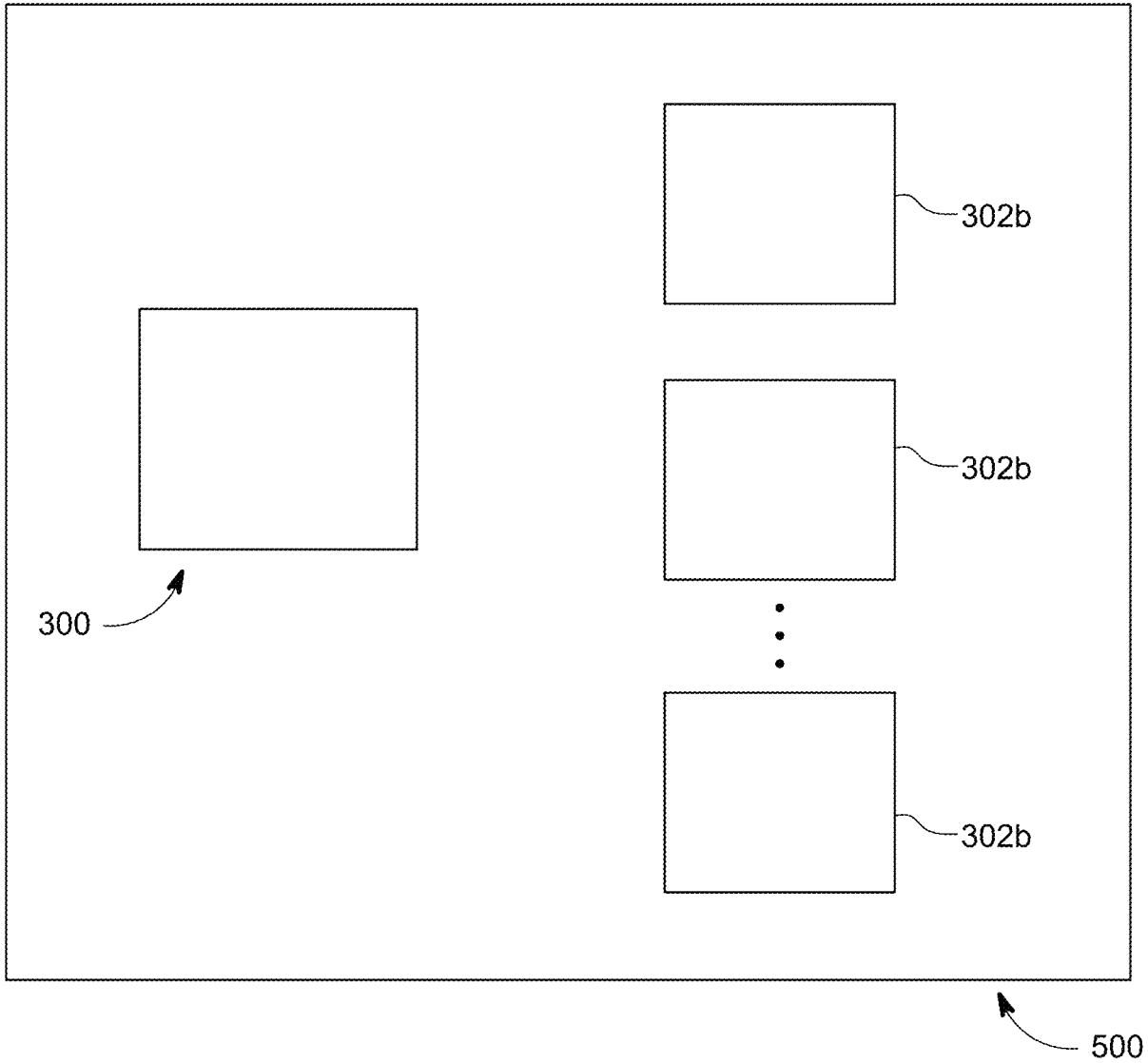

Enhanced athlete-reaction, agility-training systems 500 (FIGS. 34A, 34B) include: an enhanced athlete-reaction and primary agility-training device 300 and a plurality of enhanced auxiliary agility-training devices 300*a* or 300*b*. In embodiments, auxiliary devices 300*a* or 300*b* are distally spaced or proximally spaced to a primary device 300.

Alternatives, changes, and modifications apparent to a "POSITA" are included. Described in detail throughout this patent specification are embodiments of enhanced athlete agility-training devices and systems. While the devices and systems are described with reference to exemplary embodiments, the present subject matter is not limited to the embodiments described herein. On the contrary, a variety of alternatives, changes, and modifications will become apparent to a person of ordinary skill in the art ("POSITA") after this patent specification has been read and the accompanying FIGS. reviewed. Therefore, alternatives, changes, and modifications are to be considered as forming a part of the present subject matter insofar as they fall within the spirit and scope of appended claims.

The invention claimed is:

1. An enhanced athlete-reaction and agility-training system, the system configured for fencing training and comprising:

a frame;

a plurality of mounting plates removably secured to the frame;

an athlete reaction-training device disposed on one of the plurality of mounting plates, the athlete reaction-training device including a light-emitting device and an impact-sensitive surface connected to the light-emitting device, wherein the light-emitting device ceases emitting light when the impact-sensitive surface is impacted; and an enhanced athlete-reaction and agility-training device removably mounted on and operably associated with the athlete reaction-training device, wherein the enhanced athlete-reaction and agility-training device comprises:

a housing defining two apertures;

at least one microprocessor disposed in the housing;

an impact-generating mechanism contained within the housing, wherein the impact-generating mechanism includes a reciprocally translatable tapper member extendable and retractable through one of the two apertures;

a control unit in the housing, wherein the control unit is operably connected to the at least one microprocessor and the impact-generating mechanism; and a motion sensor contained within the housing adjacent to the other one of the two apertures, wherein the motion sensor is operably connected to a power source and to the control unit, wherein the motion sensor is adapted and configured to project a motion-detecting beam through the other one of the two apertures, wherein the enhanced athlete-reaction and agility-training device is removably secured to the athlete reaction-training device, wherein movement of a person or a thing toward or transverse to the motion sensor when sensed by the motion sensor causes the reciprocally translatable tapper member to tap the impact-sensitive surface, thereby ending light emission.

2. The enhanced athlete-reaction and agility-training system of claim 1, further comprising:

a base secured to the frame;

a vertically disposed member secured to the base;

at least one arm secured to the vertically disposed member and disposed transverse to the vertically disposed member;

a leg having an upper portion and a lower portion, wherein the upper portion is configured to be disposed toward a reaction-training athlete and includes a first end portion secured to the vertically disposed member and a second end portion comprising a knee spaced from the first end portion of the upper portion, wherein the lower portion of the leg includes a first end portion secured to the knee, wherein the lower portion of the leg includes a second end portion spaced from the first end portion of the lower portion of the leg, and wherein the second end portion of the lower portion is configured to contact a surface upon which the reaction-training athlete is standing.

3. The enhanced athlete-reaction and agility-training system of claim 1, wherein the athlete reaction-training device further includes:

at least one other microprocessor;

a controller operatively connected to the at least one other microprocessor; and a timer operatively connected to the at least one other microprocessor and the controller, wherein the controller, upon receiving a signal from the timer, causes the light-emitting device to emit light flashes for a preselected length of time.

4. The enhanced athlete-reaction and agility-training system of claim 3, wherein the power source is connected to the light-emitting device, the impact-sensitive surface, the timer, the controller, and the at least one microprocessor, and wherein the power source comprises at least one battery or an electrical connection to an electrical power provider.

5. The enhanced athlete-reaction and agility-training system of claim 4, further comprising a sound-emitting device operatively connected to at least one of the light-emitting device, the impact-sensitive surface, the timer, the controller, and the at least one microprocessor, wherein the sound-emitting device is operatively connected to the power source.

* * * * *